US006124070A

United States Patent [19]

Baba et al.

[11] Patent Number: 6,124,070

[45] Date of Patent: Sep. 26, 2000

[54] TONER AND PROCESS FOR PRODUCING TONER

[75] Inventors: Yoshinobu Baba; Tetsuro Fukui; Hiroshi Aoto; Hitoshi Itabashi, all of Yokohama; Yasukazu Ayaki, Mishima, all of Japan

[73] Assignee: Canon Kabushiki Kaisha, Tokyo, Japan

[21] Appl. No.: 09/400,550

[22] Filed: Sep. 21, 1999

[30] Foreign Application Priority Data

Sep. 25, 1998 [JP] Japan ..... 10-270634

[51] Int. Cl.[7] ..... G03G 9/087

[52] U.S. Cl. ..... 430/109; 430/111; 430/137

[58] Field of Search ..... 430/109, 111, 430/137

[56] References Cited

U.S. PATENT DOCUMENTS

| | | | |
|---|---|---|---|
| 2,297,691 | 10/1942 | Carlson | 430/31 |
| 5,340,677 | 8/1994 | Baba et al. | 430/106.6 |
| 5,470,687 | 11/1995 | Mayama et al. | 430/137 |
| 5,744,278 | 4/1998 | Ayaki et al. | 430/110 |
| 5,985,502 | 11/1999 | Ayaki et al. | 430/109 |

FOREIGN PATENT DOCUMENTS

| | | |
|---|---|---|
| 5-093002 | 4/1993 | Japan . |
| 6-052432 | 2/1994 | Japan . |
| 6-058543 | 3/1994 | Japan . |
| 6-058544 | 3/1994 | Japan . |
| 10-232509 | 9/1998 | Japan . |

*Primary Examiner*—Roland Martin
*Attorney, Agent, or Firm*—Fitzpatrick, Cella, Harper & Scinto

[57] ABSTRACT

The present invention relates to a toner which forms a high quality image, which is stable in various environments, i.e. under high humidity, or low temperature and low humidity conditions, and has a fine particle diameter as well as a sharp particle size distribution, and to a process for producing the same. The toner contains at least a binder resin and a colorant, and has (i) a number average particle diameter of from 0.5 to 6.0 $\mu$m, (ii) the coefficient of variation of number distribution of not more than 20%, and (iii) a methanol-soluble resin component in an amount of 0.01–10% based on the weight of the toner, and the methanol-soluble resin component contains a polymer composition having an organic acid group, and an acid value of from 50 to 600 mgKOH/g.

31 Claims, No Drawings

TONER AND PROCESS FOR PRODUCING TONER

BACKGROUND OF THE INVENTION

1. Field of the Invention

The present invention relates to a toner for developing an electrostatic latent image, or a toner for forming a toner image in the image forming process by toner jet method, and to a process for producing the same.

2. Description of the Prior Art

In electrophotography, a number of methods are known as disclosed in U.S. Pat. No. 2,297,691 and Japanese Patent Publications No. 42-23910 and No. 43-24748. In general, copies or printed materials are obtained by forming an electrostatic latent image utilizing a photoconductive material according to various means on a photosensitive member, subsequently developing the latent image by the use of a toner to form a toner image, and transferring the toner image to a transfer medium such as paper if necessary by direct or indirect means, followed by fixation with heat, pressure, heat-and-pressure, or solvent vapor. The toner which is not transferred and left on the photosensitive member is removed by various means if necessary, and then the above process is repeated.

Such toners as mentioned above are powders which generally comprise a binder resin and a colorant as main components, and further contain a charge control agent and a fixing assistant and the like. In general, the particle size thereof is in a range from a few microns to about 20 to 30 microns. Such toner has been typically produced by so called pulverization method, in which a colorant such as a dye, a pigment or a magnetic substance is mixed in a thermoplastic resin and melted, so that the colorant is homogeneously dispersed in the thermoplastic resin, then it is pulverized and classified.

In recent years, an image forming apparatus employing electrophotography has been widely used not only as a copying machine for office work to take copies of original texts, but also as a full color output machinery of high image quality, and a high-resolution output machinery connected with computers. In addition, as the computers have been used for general purposes, the printer has also been used as a personal printer for private use, therefore, there has been a demand for high-resolution and quality images in various environments.

Consequently, the requirement for toner performance has become higher and higher; because without the improvement of the toner performance, that allows the images to be of high quality in various environments, excellent image formation cannot be carried out.

One of the means to achieve such quality images is a method of reducing the particle size of the toner. Indeed, by reducing the particle size of the toner to several microns, the picture quality and the resolution have been improved.

However, for the toner which has been produced in the conventional pulverization method, it has been difficult to provide a particle having a diameter of not more than about 5 $\mu$m, since when high impact force is applied to the particles to reduce the size thereof, the pulverized substances may be fused onto the pulverizing apparatus. Also, in the classification procedure, when the particle size of a toner is reduced, the cohesive force of the powder particle is increased, and it requires great effort to provide a toner having a sharp particle distribution. When the particle distribution of the toner is broad, it becomes difficult to control the charge quantity of the toner and problems such as scattering or spattering of the images or fogging on the images tend to be caused.

In order to improve the reduction in the particle size of the toner, and to have a sharper particle size distribution of the toner, a process to produce a toner by polymerization has been proposed. For example, Japanese Patent Publication No. 6-52432 and Japanese Patent Laid-Open No. 5-93002 disclose a method of producing particles of around 1–10 $\mu$m, having a sharp particle size distribution. In a method disclosed in Japanese Patent Publication No. 6-58543 and Japanese Patent Publication No. 6-58544, particles for image formation having a sharp particle size distribution are produced, wherein, in addition to the sharp particle size distribution, the particles have stabilized charge characteristics and improved functionality since they are coated with a colorant or a conductive substance and a binder resin.

Though such particles having a sharp particle size distribution have excellent fluidity, they are formed by closest packing. Therefore, particularly when these particles are left in a high temperature environment, a problem of aggregation of the toner arises. When the particles are coated with the colorant or a conductive substance and the like in order to acquire the above-mentioned functionality, aggregation occurs more easily in the case of closest packing due to the unevenness in the microstructure on the toner surface. When a toner or a developing agent causes aggregation, charging failure tends to occur and that ultimately leads to a problem of inferior resolution of the developed image.

When a conductive substance is coated on toner particles, the toner particles have appropriate charges in the normal temperature and normal humidity environment. However, they cannot maintain the charges under high humidity conditions, and problems such as fogging occur due to the charging failure.

In Japanese Patent Laid-Open No. 10-232509, a toner for developing an electrostatic image has been proposed, in which the maximum glass transition point of a methanol soluble resin component which is extracted by a Soxhlet extractor employing methanol, and the maximum glass transition point of a tetrahydrofuran (THF) soluble resin component which is extracted by Soxhlet extractor employing tetrahydrofuran following the extraction with methanol, satisfy a specific relation. The toner proposed in that publication allows good image formation under a high temperature condition, however, image formation under high humidity condition and image formation under low temperature and low humidity conditions are still in need of improvement.

SUMMARY OF THE INVENTION

An object of the present invention is to provide a toner in which the above-mentioned problems are solved, and a process for producing the same.

Another object of the present invention is to provide a toner which concurrently satisfies high quality image formation and environmental stability, has stability under high humidity as well as at low temperature-low humidity, has a fine particle size and a sharp particle diameter distribution, and a process for producing the same.

Therefore, an object of the present invention is to provide a toner containing at least a binder resin and a colorant, comprising (i) a number average particle diameter thereof from 0.5 to 6.0 $\mu$m, (ii) the coefficient of variation of number distribution of not more than 20%, and (iii) a methanol-soluble resin component which is extracted by methanol solvent in an amount of 0.01–10% by weight based on the weight of the toner, wherein the methanol-soluble resin component contains a polymer composition having an organic acid group, and an acid value (Av) from 50 to 600 mgKOH/g.

Another object of the present invention is to provide a process for producing a toner, comprising the steps of: (a) dissolving (i) a polymerizable monomer which is soluble in a polymerization solvent and which forms a polymer by polymerization which is not soluble in the polymerization solvent, and (ii) a polymer composition containing an organic acid group, in the polymerization solvent to prepare a polymerization reaction system; (b) polymerizing the polymerizable monomer in the presence of a polymerization initiator by controlling the amount of dissolved oxygen in the polymerization reaction system at the start of the polymerization reaction to not more than 2.0 mg/l to form toner particles; and (c) obtaining toner particles from the polymerization reaction system and forming a toner from the toner particles; wherein the polymer composition containing the organic acid group is soluble in the polymerization solvent, and has an acid value of from 50 to 600 mgKOH/g, wherein the toner comprising (i) a number average particle diameter of from 0.5 to 6.0 μm, (ii) the coefficient of variation of number distribution of not more than 20%, and (iii) a methanol-soluble resin component which is extracted by methanol solvent in an amount of 0.01–10% by weight based on the weight of the toner, wherein the methanol-soluble resin component contains the polymer composition having an organic acid group, and an acid value (Av) of from 50 to 600 mgKOH/g.

DESCRIPTION OF THE PREFERRED EMBODIMENTS

The present inventors have discovered, that authentic development of a latent image can be carried out with the use of a toner having such a fine particle diameter that a number average particle diameter is from 0.5 to 6.0 μm. The present inventors also found that for a toner having such a fine particle diameter, it is necessary that the coefficient of variation of number distribution is not more than 20% for controlling the variations in charging. The present inventors also discovered that it is effective that the resin component extracted by methanol is contained in an amount of 0.01–10% by weight, in order to prevent the packing of the toner particles having such a fine and controlled particle size when they are allowed to stand, and the resulting aggregation of the toner. The present inventors also found that when the resin component extracted by methanol contains a polymer composition having an organic acid group, and when the acid value (Av) is between 50 and 600 mgKOH/g, the toner has good charge characteristics in variety of environments from low humidity environment to high humidity environment, and, therefore, stabilized output image can be obtained.

It is important that a toner according to the present invention has a number average particle diameter of from 0.5 to 6.0 μm, preferably of from 1.0 to 5.0 μm. This is necessary for obtaining images of high definition. When the particle diameter is less than 0.5 μm, the handling thereof as a dry powder becomes difficult. When the particle diameter exceeds 6 μm, fine dot latent images cannot be faithfully developed, therefore the reproducibility of especially highlighted material is reduced.

In addition, according to the present invention it is desirable that the toner has the coefficient of variation of particle number distribution of not more than 20%, preferably not more than 18%.

The coefficient of variation of particle number distribution of the toner can be calculated according to the following equation.

$$\text{Coefficient of variation (\%)} = \frac{\text{Standard deviation of particle number distribution}}{\text{Number average particle diameter}} \times 100$$

In the present invention, in addition to the average particle diameter of the toner, the width of the particle diameter distribution greatly contributes to the reproducibility of the images particularly in the transferring process. That is, even though the average particle diameter is within the range of the present invention, when the coefficient of variation exceeds 20%, spattering may be caused during the transferring process or some toner particles are not transferred but remain, and, particularly halftone reproducibility becomes inferior.

The toner of the present invention contains a methanol-soluble resin component extracted by methanol, in an amount of 0.01–10% by weight based on the toner weight, and the methanol-soluble resin component extracted by methanol contains a polymer composition having an organic acid group, and an acid value (Av) of from 50 to 600 mgKOH/g.

When the methanol-soluble resin component extracted by methanol is less than 0.01% by weight, the toner does not show improved stability to environments. When it is over 10% by weight, too much water is adsorbed on the surface of the toner and the charge quantity is lowered in high humidity environment disadvantageously. Preferable amounts are from 0.2 to 8% by weight, and more preferably from 0.5 to 7.5% by weight.

The methanol-soluble resin component extracted by methanol includes a methanol-soluble resin component which exists near the surface of the toner which methanol can penetrate. Although the major portion of the methanol-soluble resin component is thought to be a resin component near the surface of the toner, a smaller amount of residual monomer, initiator and other additives may also be contained therein.

According to the present invention, in addition to the methanol-soluble resin component extracted by methanol, the resin component contains a polymer composition having an organic acid group, and has an acid value (Av) of from 50 to 600 mgKOH/g. It is considered that when the toner of the present invention contains, in the surface layer, a polymer composition having a high acid value containing an organic acid group, a suitable moisture-retaining effect is provided on the toner surface. Therefore, the toner acquires the above-mentioned good stability to the environment. At the same time, toner particles having a sharp particle size distribution can be obtained by producing particles by a process wherein a polymer composition having an organic acid group is dissolved in a polymerization reaction system during toner production.

As mentioned above, the acid value of the solvent-soluble resin component extracted by methanol is from 50 to 600 mgKOH/g, preferably, from 100 to 550 mgKOH/g, and, more preferably, from 100 to 500 mgKOH/g. When the acid value is less than 50 mgKOH/g, the toner does not show fully improved stability to the environment and when it is over 600 mgKOH/g, an excess amount of organic acid groups exists and the charge quantity is rather reduced in a high humidity environment.

The number average particle diameter of the toner of the present invention is from 0.5 to 6.0 $\mu$m, which is a particle diameter at which charge characteristics cannot normally be easily controlled. However, by controlling the coefficient of variation of the number distribution of the toner particles and the contents of organic acid group and aryl group near the surface of the toner, charging of the toner can be controlled in various environments. Therefore, an acid content (MAv) near the surface of the toner which is calculated from a content of the methanol soluble resin component extracted by methanol, M (% by weight) and an acid value thereof, Av (mgKOH/g), according to the following equation, is important. (MAv)=(M)×(Av)

According to the present invention, the value of the MAv is preferably from 0.5 to 6000, more preferably from 50 to 3000 and most preferably from 100 to 1000.

The kinds of the organic acid group used according to the present invention are not particularly limited, and a general organic acid group can be employed. For example, carboxyl group, sulfonic group, sulfinic group and phosphonic group, phenolic hydroxyl group (hydroxyl group bonded to the aryl group) can be used. Preferable examples include carboxyl group, sulfinic group, phosphonic group, and phenolic hydroxyl group. More preferable examples include carboxyl group and phenolic hydroxyl group. Even more preferable is the carboxyl group. When the carboxyl group is employed, a toner having even better stability to the variation of the environment can be provided.

According to the present invention, it is preferable that the methanol-soluble resin component extracted with methanol contains at least one repeating unit (I) and at least one repeating unit (II) represented by the following structural formulae, and the total number of the repeating unit (I) and the repeating unit (II) is 50% or more of the number of the units comprising the entire methanol-soluble resin component extracted by methanol, and the number of units of the repeating unit (I) is preferably from 30 to 70% of the total number of the repeating unit (I) and unit (II).

(I)

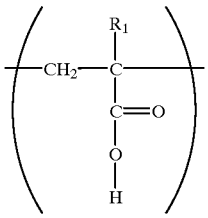

(II)

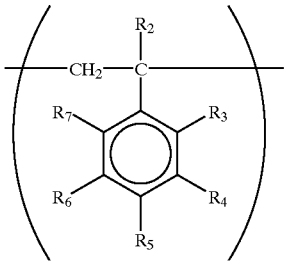

When the total number of the repeating unit (I) and repeating unit (II) is below 50% of the resin component extracted by methanol, sufficient stability to different environments is difficult to attain. When the number of the repeating unit (I) is less than 30% of the total number of the repeating unit (I) and repeating unit (II), the charge quantity of the toner in a low humidity environment tends to be raised. When it is more than 70%, the charge quantity of the toner in a high humidity environment can be lowered in some cases. Furthermore, when repeating unit (I) and repeating unit (II) satisfy the above-mentioned conditions, the resin component extracted by methanol has good affinity with other resin components, therefore the effects as described above can be obtained.

When a polymer composition having at least repeating unit (I) and repeating unit (II) represented by the above-mentioned structural formulae is used according to the present invention, two or more kinds of repeating unit (I) can be used. Similarly, two or more kinds of repeating unit (II) can be used as well. In the above-mentioned structural formulae, $R_1$ and $R_2$ represent a hydrogen atom, a substituted or unsubstituted alkyl group, or a halogen atom, $R_3$–$R_7$ represent a hydrogen atom, a substituted or unsubstituted alkyl group, a halogen atom, nitrile group, hydroxyl group, carboxyl group, sulfonic group or amino group.

Examples of the repeating unit (I) include, for example, carboxyethylene group, 1-carboxy-1-methyl ethylene group, 1-carboxy-1-fluoromethyl ethylene group, 1-carboxy-1-trifluoromethyl ethylene group, 1-carboxy-1-hydroxymethyl ethylene group, 1-carboxy-1-carboxymethyl ethylene group, 1-carboxy-1-ethyl ethylene group, 1-carboxy-1-n-propyl ethylene group, 1-carboxy-1-isopropyl ethylene group, 1-carboxy-1-n-butyl ethylene group, 1-carboxy-1-isobutyl ethylene group, 1-carboxy-1-t-butyl ethylene group, 1-carboxy-1-n-pentyl ethylene group, 1-carboxy-1-isopentyl ethylene group, 1-carboxy-1-neopentyl ethylene group, 1-carboxy-1-t-pentyl ethylene group, 1-carboxy-1-n-hexyl ethylene group, 1-carboxy-1-isohexyl ethylene group, 1-carboxy-1-fluoroethylene group and the like.

Examples of the repeating unit (II) include, for example, phenyl ethylene group, 1-phenyl-1-methyl ethylene group, 1-phenyl-1-fluoromethyl ethylene group, 1-phenyl-1-trifluoromethyl ethylene group, 1-phenyl-1-hydroxymethyl ethylene group, 1-phenyl-1-carboxymethyl ethylene group, 1-phenyl-1-ethyl ethylene group, 1-phenyl-1-n-propyl ethylene group, 1-phenyl-1-isopropyl ethylene group, 1-phenyl-1-n-butyl ethylene group, 1-phenyl-1-isobutyl ethylene group, 1-phenyl-1-t-butyl ethylene group, 1-phenyl-1-n-pentyl ethylene group, 1-phenyl-1-isopentyl ethylene group, 1-phenyl-1-neopentyl ethylene group, 1-phenyl-1-t-pentyl ethylene group, 1-phenyl-1-n-hexyl ethylene group, 1-phenyl-1-isohexyl ethylene group, 1-phenyl-1-fluoroethylene group, o-tolyl ethylene group, 1-(o-tolyl)-1-methyl ethylene group, 2,3-xylyl ethylene group, 1-(2,3-xylyl)-1-methyl ethylene group, m-cumenylethylene group, 1-(m-cumenyl)-1-methyl ethylene group, mesityl ethylene group, 1-mesityl-1-methyl ethylene group, p-trifluoromethylphenyl ethylene group, 1-(p-trifluoromethylphenyl)-1-methyl ethylene group, p-methoxymethylphenyl ethylene group, 1-(p-methoxymethylphenyl)-1-methyl ethylene group, p-hydroxymethylphenyl ethylene group, 1-(p-hydroxymethylphenyl)-1-methyl ethylene group, p-aminomethylphenyl ethylene group, 1-(p-aminomethylphenyl)-1-methyl ethylene group, pentafluorophenyl ethylene group, 1-pentafluorophenyl-1-methyl ethylene group, p-nitrilephenyl ethylene group, 1-(p-nitrilephenyl)-1-methyl ethylene group, p-hydroxyphenyl ethylene group, 1-(p-hydroxyphenyl)-1-methyl ethylene group, p-carboxyphenyl ethylene group, 1-(p-carboxyphenyl)-1-methyl ethylene group, p-sulfophenyl ethylene group, 1-(p-sulfophenyl)-1-methyl ethylene group, p-aminophenyl ethylene group, and 1-(p-aminophenyl)-1-methyl ethylene group.

Examples of a polymer composition containing the repeating unit (I) and the repeating unit (II) of the present invention include, for example, styrene-acrylic acid copolymer, α-methylstyrene-acrylic acid copolymer, styrene-methacrylic acid copolymer, α-methylstyrene-methacrylic acid copolymer, styrene-α-methylstyrene-acrylic acid copolymer, styrene-methylstyrene-methacrylic acid copolymer, styrene-acrylic acid-methacrylic acid copolymer, α-methylstyrene-acrylic acid-methacrylic acid copolymer, styrene-α-methyl styrene-acrylic acid-methacrylic acid copolymer, styrene-α-methylstyrene-acrylic acid-ethyl acrylate copolymer, styrene-itaconic acid copolymer, and α-methylstyrene-itaconic acid copolymer. Among them, copolymers containing α-methyl styrene are preferable, and copolymers containing styrene and α-methyl styrene are further preferable.

According to the present invention, it is preferable that the polymer composition has a repeating unit having a hydrocarbon group containing three or more carbon atoms in a side chain. More preferably it is a hydrocarbon substituent containing 5 or more carbon atoms. This allows the polymer composition to have better compatibility with other resin components. Therefore, the production process of the toner particles can be stabilized and the toner has good stability to different environments.

Examples of the hydrocarbon group include an alkyl group, cycloalkyl group, alkenyl group, cycloalkenyl group, aryl group, alkoxyl group, aryloxyl group, alkoxycarbonyl group, aryloxycarbonyl group, acyl group, acyloxyl group, and heterocyclic group.

More specifically, examples of the alkyl group include n-propyl group, isopropyl group, 3,3,3,2,2-pentafluoro-n-propyl group, n-butyl group, s-butyl group, t-butyl group, 4-cyano-n-butyl group, 4-amino-n-butyl group, n-pentyl group, t-pentyl group, isopentyl group, neopentyl group, n-hexyl group, heptyl group, octyl group, nonyl group, decyl group, and dodecyl group. Examples of a cycloalkyl group include cyclopropyl group, cyclopentyl group, cyclohexyl group, cycloheptyl group and cyclooctyl group. Examples of an alkenyl group include allyl group, 1-propenyl group, isopropenyl group, 2-pentenyl group, 2-butenyl group, and 3-methyl-2-butenyl group. An example of a cycloalkenyl group includes, the cyclohexenyl group. Examples of an aryl group include phenyl group, o-toluyl group, m-toluyl group, p-toluyl group, p-ethylphenyl group, xylyl group, p-n-butylphenyl group, p-tert-butylphenyl group, p-n-hexylphenyl group, p-n-octylphenyl group, p-n-nonylphenyl group, p-n-decylphenyl group, p-n-dodecylphenyl group, benzyl group, p-hydroxyphenyl group, p-methoxyphenyl group, p-carboxyphenyl group, p-sulfophenyl group, biphenylyl group, p-fluorophenyl group, m, p-difluorophenyl group, naphthyl group, and anthryl group. Examples of an alkoxyl group include t-butoxyl group, n-propoxyl group, isopropoxyl group, n-pentoxyl group, and hydroxytriethoxy group. An example of an aryloxyl group includes the phenoxy group. Examples of an alkoxycarbonyl group include n-propoxycarbonyl group, isopropoxycarbonyl group, pentyloxycarbonyl group, and 3-chloro-2-acid phosphoxy propoxycarbonyl group. An example of an aryloxycarbonyl group includes the phenoxycarbonyl group. Examples of an acyl group include valeryl group and benzoyl group. Examples of an acyloxyl group include n-propylcarbonyloxy group, isopropylcarbonyloxy group, pentylcarbonyloxy group, benzoyloxy group, and benzylcarbonyloxy group. Examples of a heterocyclic group include 2-pyrrolyl group, 2-pyridyl group, 2-quinolyl group, morpholino group, imidazolyl group, 2-pyrrolidinonyl group, and N-carbazolyl group.

For the toner of the present invention, the methanol-soluble resin component extracted by methanol preferably has a weight average molecular weight (Mw) obtained by measurement by GPC converted to polystyrene basis of from 4,000 to 400,000, and more preferably it is from 10,000 to 100,000. Also a component having a molecular weight of from 200 to 1000 preferably has a content based on the weight of the toner of from 0.01 to 3% by weight. Having such a molecular weight, the toner of the present invention can contain a stabilized charge quantity in various conditions and the tendency to block and aggregate at a high temperature environment can be controlled more satisfactorily.

Preferable ways for producing the toner of the present invention include the following methods.

The toner of the present invention is preferably produced by (a) adding a polymerizable monomer which is soluble in a polymerization solvent and which forms a polymer by polymerization which is not soluble in the polymerization solvent, and a polymer composition which is soluble in the polymerization solvent, to the polymerization solvent to prepare a polymerization reaction system; (b) polymerizing the polymerizable monomer in the presence of a polymerization initiator by setting the amount of dissolved oxygen in the polymerization reaction system at the start of the polymerization reaction to not more than 2.0 mg/l to form toner particles; and (c) obtaining toner particles from the polymerization reaction system and forming a toner from the obtained toner particles.

In the process for producing the toner according to the present invention, particles having uniform particle size distribution can be produced by initiating the polymerization at a condition where the amount of dissolved oxygen in the polymerization reaction system at the start of the polymerization reaction is not more than 2.0 mg/l.

The amount of dissolved oxygen according to the present invention is measured successively by a dissolved oxygen meter (Dissolved Oxygen Meter Model 3600 manufactured by Orbisphere Laboratries). The type of the membrane used in the present invention was 29552A (Manufactured by Orbisphere Laboratries), the material was PTFE, the thickness was 50 μm. The solution from the reaction vessel was sent through a PTFE tube to the flow cell of the dissolved oxygen meter, and the amount of the dissolved oxygen was measured in a closed system.

'At the start of the polymerization' is defined here to be a point in time when the polymerization conversion ratio exceeds 5%. The measurement of the polymerization conversion ratio was calculated as the rate of change in the integrated value of the monomer peak by gas chromatography (GC). The polymerization reaction solution was measured by internal standard method under the following conditions.

Preparation of a Sample 3 g of a sample and 30 g of toluene were weighed into a sample bottle of 50 ml and mechanically shaken for 30 minutes. 1 g of a supernatant obtained by filtration through a filter having a pore size of 1 μm, and 0.2 g of dimethyl formamide as an internal standard substance were weighed into a vial and a cap was put on the vial.

GC Measuring Conditions

Measuring apparatus: HP6890 (manufactured by HP)

Carrier gas: helium

Split (split ratio 100:1), linear velocity 35 cm/sec

Column: HP-INNOWax (60 m, 0.25 mm, 0.25 μm)

Temperature rise: 40° C. held for 20 minutes, then heated at temperature rising speed of 20° C./min to 200° C.

Detector: FID 220° C.

Amount of the injected sample: 2 μl

A preferable amount of dissolved oxygen according to the present invention is not more than 2.0 mg/l, more preferably not more than 0.5 mg/l. When the amount of dissolved oxygen exceeds 2.0 mg/l, the oxygen in the polymerization reaction system inhibits the polymerization and the polymerization reaction does not progress uniformly so that the width of particle size distribution of the toner is broadened, or it becomes difficult for the polymer composition to be incorporated efficiently near the surface of the toner particle.

Examples of a method of controlling the amount of the dissolved oxygen include (1) a method in which an inactive or inert gas such as helium, nitrogen and argon is released into the liquid of the polymerization reaction system and the oxygen is replaced therewith, and (2) a method in which deoxygenation is carried out with ultrasonic vibration. These methods can be employed alone or in combination.

When the method of (1) is employed, it is preferable that a gas introduction tube is inserted into the reaction medium of the polymerization reaction system and the gas is bubbled thereinto through the introduction tube. The gas used for replacing the oxygen can be any gas as far as it does not contain oxygen, is soluble in the reaction medium, and has no polymerization inhibiting activities. Examples thereof include an inactive or inert gas such as helium, nitrogen and argon and these can be used alone or in admixture.

The flow rate of the gas into the polymerization reaction system depends on the kind of the gas, the air temperature and the volume of the reaction medium. A preferable flow rate is from 5 to 100 vol %/min based on the volume of the reaction vessel, and the amount of the gas introduced prior to the start of the polymerization reaction is preferably from 2 to 30 times that of the volume of the reaction vessel.

During the polymerization reaction, it is preferable that such replacement by the inactive gas as mentioned above is continued.

When the method of (2) is employed, ultrasonic waves are directly applied to the polymerization reaction system. As the ultrasonic wave applying apparatus, an ordinary ultrasonic cleaner or ultrasonic homogenizer can be used. The intensity of the ultrasonic waves is preferably such that the molecular weight of the polymerization composition existing in the polymerization reaction system does not change thereby.

As a polymerization solvent preferably used according to the present invention, any organic solvent or a mixed solvent comprising the organic solvent and water can be employed. A preferable solvent is an organic solvent which does not react with the polymerizable monomer composition. When a mixed solvent comprising the organic solvent and water is employed, water is used in an amount of from 0.1 to 50% by weight, preferably from 0.1 to 40% by weight, more preferably from 0.1 to 30% by weight, and most preferably from 0.5 to 20% by weight. When a large amount of water of more than 50% by weight is present in the mixed solvent, a problem may arise such that uniform toner particles cannot be obtained.

Examples of an organic solvent used as a polymerization solvent according to the present invention include alcohols such as methanol, ethanol, 1-propanol, 2-propanol, 1-butanol, 2-butanol, isobutyl alcohol, tert-butyl alcohol, 1-pentanol, 2-pentanol, 3-pentanol, 2-methyl-1-butanol, isopentyl alcohol, tert-pentyl alcohol, 1-hexanol, 2-methyl-1-pentanol, 4-methyl-2-pentanol, 2-ethyl butanol, 1-heptanol, 2-heptanol, 3-heptanol, 2-octanol, 2-ethyl-1-hexanol, benzyl alcohol, and cyclohexanol; ether alcohols such as methyl cellosolve, cellosolve, isopropyl cellosolve, butyl cellosolve, and diethylene glycol monobutyl ether; ketones such as acetone, methyl ethyl ketone, methyl isobutyl ketone, and cyclohexanone; esters such as ethyl acetate, butyl acetate, ethyl propionate, and cellosolve acetate; aliphatic or aromatic hydrocarbons such as pentane, 2-methyl butane, n-hexane, cyclohexane, 2-methylpentane, 2,2-dimethylbutane, 2,3-dimethylbutane, heptane, n-octane, isooctane, 2,2,3-trimethylpentane, decane, nonane, cyclopentane, methyl cyclopentane, methyl cyclohexane, ethyl cyclohexane, p-menthane, benzene, toluene, xylene, and ethyl benzene; halogenated hydrocarbons such as carbon tetrachloride, trichloroethylene, chlorobenzene, and tetrabromoethane ethane; ethers such as ethyl ether, dimethyl ether, and trioxane tetrahydrofuran; acetals such as methylal, and diethyl acetal; aliphatic acids such as formic acid, acetic acid and propionic acid; and organic compounds containing sulfur/nitrogen such as nitropropene, nitrobenzene, dimethyl amine, monoethanol amine, pyridine, dimethylformamide, and dimethylsulfoxide.

Examples of a polymerizable monomer for producing a binder resin used according to the present invention include, for example, styrene type monomers such as styrene, o-methyl styrene, m-methyl styrene, p-methoxy styrene, p-ethyl styrene, and p-tert-butyl styrene; acrylic esters such as acrylic acid, methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate, and phenyl acrylate; methacrylic esters such as methacrylic acid, methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethyl aminomethyl methacrylate, dimethyl aminoethyl methacrylate, diethylaminoethyl methacrylate, and benzyl methacrylate; 2-hydroxyethyl acrylate, 2-hydroxyethyl methacrylate, acrylonitrile, methacrylonitrile, acrylamide, and alkylvinyl ethers such as methyl vinyl ether, ethyl vinyl ether, propyl vinyl ether, n-butyl ether, and isobutyl ether; diene compounds such as β-chloroethyl vinyl ether, phenyl vinyl ether, p-methyl phenyl ether, p-chlorophenyl ether, p-bromophenyl ether, p-nitrophenyl vinyl ether, p-methoxyphenyl vinyl ether, and butadiene; crotonic acid, itaconic acid, maleic acid, fumaric acid, monobutyl itaconate, monobutyl maleate, and monomers containing phosphoric acid, such as acid phospho oxyethyl methacrylate, acid phospho oxypropyl methacrylate, monomers containing sulfonic group, dimethyl aminoethyl acrylate, diethyl aminoethyl methacrylate, acryloylmorpholine, 2-vinyl pyridine, 3-vinyl pyridine, 4-vinylpyridine, N-vinyl pyrrolidone, 2-vinyl imidazole, N-methyl-2-vinyl imidazole, and N-vinylimidazole.

These monomers can be used alone or in admixture of two or more kinds so as to provide a polymer composition which can provide desirable characteristics.

According to the present invention, a high molecular weight component or a gel component can be present. Introduction of such a component can be achieved by the use of a crosslinking agent having two or more polymerizable double bonds in one molecule. Examples of such a crosslinking agent include, for example, aromatic divinyl compounds such as divinylbenzene, and divinylnaphthalene; and ethylene glycol diacrylate, ethylene glycol dimethacrylate, triethylene glycol dimethacrylate, tetraethylene glycol dimethacrylate, 1,3-butylene glycol dimethacrylate, trimethylol propane triacrylate, trimethylol propane trimethacrylate, 1,4-butanediol diacrylate, neopentyl glycol diacrylate, 1,6-hexane diol diacrylate, pentaerythritol triacrylate, pentaerythritol tetraacrylate, pentaerythritol dimethacrylate, pentaerythritol tetramethacrylate, N,N-divinyl aniline, divinyl ether, divinyl sulfide, and divinyl sulfone. Two or more kinds can be mixed and used if necessary. Such a crosslinking agent can be previously mixed in a polymerizable mixture or can be added in the middle of polymerization, if necessary.

In the process for producing the toner according to the present invention, a toner particle cleaning step after the polymerization is also important. As a cleaning solvent, a solvent similar to the polymerization solvent employed for polymerization can be used. However, a mixed solvent containing a saturated alcohol of the following chemical formula-1 in an amount of 30% by weight is more preferably employed.

$$C_nH_{2n+1}OH \qquad \text{(chemical formula-1)}$$

n=1–5

It is further preferred that the mixed solvent used for the cleaning step contains water in an amount from 0.1 to 70% by weight. It is preferable that the water content is larger than that of the solvent used for polymerization. Furthermore, it is also preferable that the toner particles are washed with water at the end of the cleaning step. In this way, the above-mentioned cleaning step is important in order to remove a low molecular weight component, while a methanol-soluble resin component extracted by methanol is allowed to be present in a desired amount on the surface of the toner. The methanol-soluble resin component is allowed to be present in a desired amount even when different materials are employed, by appropriately selecting the number of cleanings between 1 and about 10.

According to the present invention, the specific cleaning step of the toner particles is carried out by the following procedure. The reaction mixture after completion of the polymerization is filtered under pressure such that the content of the volatile component becomes 100–300% by weight based on the toner particles. The toner particles obtained in the above-mentioned step were added to a cleaning solvent which solvent is present in an amount of 20 times the weight of the toner particles, and sufficiently agitated until no coagulated sedimentation was found. Then the dispersed particles are filtered under pressure until the content of the volatile component becomes 100–300% by weight of the toner particles to complete one cleaning cycle. From the second cleaning cycle onwards, the toner particles are similarly added to a cleaning solvent in an amount of 20 times the weight of the toner particles and cleaned.

The cleaned toner particles are dried and used as a toner. However, the drying process is not particularly limited and the toner can be obtained in a drying process which has been conventionally employed.

The toner of the present invention can be subjected to a conventional classification procedure following the drying process, if necessary.

According to the present invention, any known colorant can be used. The toner can be dyed by any means such as a process in which the colorant is added together with the polymerizable monomer composition so that it can be incorporated into the toner concurrently with the polymerization, or a process in which after the particles are obtained, they are dyed with a dyeing agent in a hot solvent and the like.

Examples of the colorant include carbon black or known organic colorants including a dye stuff such as C.I. Direct Red 1, C.I. Basic Red 1, C.I. Mordant Red 30, C.I. Direct Blue-1, C.I. Direct Blue-2, C.I. Acid Blue-15, C.I. Basic Blue-3, C.I. Basic Blue-5, C.I. Mordant Blue-7, C.I. Direct Green 6, C.I. Basic Green 4, and C.I. Basic Green 6; pigments such as Cadmium Yellow, Mineral First Yellow, Navel Yellow, Naphthol Yellow S, Hansa Yellow G, Permanent Yellow NCG, Tartrazine Lake, Molybdenum Orange GTR, Benzidine Orange G, Cadmium Red 4R, Watchung Red Calcium Salt, Brilliant Carmine 3B, Fast Violet B, Methyl Violet Lake, Cobalt Blue, Alkali Blue Lake, Victoria Blue Lake, Quinacridone, Rhodamine Lake, Phthalocyanine Blue, Fast Sky Blue, Pigment Green B, Malachite Green Lake, and Final Yellow Green G; C.I. Solvent Yellow 6, C.I. Solvent Yellow 9, C.I. Solvent Yellow 17, C.I. Solvent Yellow 31, C.I. Solvent Yellow 35, C.I. Solvent Yellow 100, C.I. Solvent Yellow 102, C.I. Solvent Yellow 103, C.I. Solvent Yellow 105, C.I. Solvent Orange 2, C.I. Solvent Orange 7, C.I. Solvent Orange 13, C.I. Solvent Orange 14, C.I. Solvent Orange 66, C.I. Solvent Red 5, C.I. Solvent Red 16, C.I. Solvent Red 17, C.I. Solvent Red 18, C.I. Solvent Red 19, C.I. Solvent Red 22, C.I. Solvent Red 23, C.I. Solvent Red 143, C.I. Solvent Red 145, C.I. Solvent Red 146, C.I. Solvent Red 149, C.I. Solvent Red 150, C.I. Solvent Red 151, C.I. Solvent Red 157, C.I. Solvent Red 158, C.I. Solvent Viol et 31, C.I. Solvent Violet 32, C.I. Solvent Violet 33, C.I. Solvent Violet 37, C.I. Solvent Blue 22, C.I. Solvent Blue 63, C.I. Solvent Blue 78, C.I. Solvent Blue 83, C.I. Solvent Blue 84, C.I. Solvent Blue 85, C.I. Solvent Blue 86, C.I. Solvent Blue 104, C.I. Solvent Blue 191, C.I. Solvent Blue 194, C.I. Solvent Blue 195, C.I. Solvent Green 24, C.I. Solvent Green 25, C.I. Solvent Brown 3, and C.I. Solvent Brown 9. Examples of commercially available dyes include, for example, Dia Resin Series available from Mitsubishi Chemical Industries Ltd. such as Dia Resin Yellow-3G, Yellow-F, Yellow-H2G, Yellow-HG, Yellow-HC, Yellow-HL, Orange-HS, Orange-G, Red-GC, Red-S, Red-HS, Red-A, Red-K, Red-H5B, Violet-D, Blue-J, Blue-G, Blue-N, Blue-K, Blue-P, Blue-H3G, Blue-4G, Green-C, and Brown-A; Indigo SOT dyes manufactured by Hodogaya Chemical Co., Ltd., such as Yellow-1, Yellow-3, Yellow-4, Orange-1, Orange-2, Orange-3, Scarlet-1, Red-1, Red-2, Red-3, Brown-2, Blue-1, Blue-2, Violet-1, Green-1, Green-2, Green-3, Black-1, Black-4, Black-6, and Black-8; sudan dyes available from BASF, such as Yellow-146, Yellow-150, Orange-220, Red-290, Red-380, Red-460, and Blue-670; Oil Black, Oil Color Yellow-3G, Yellow-GG-S, Yellow-#105, Orange-PS, Orange-PR, Orange-#201, Scarlet-#308, Red-5B, Brown-GR, Brown-#416, Green-BG, Green-#502, Blue-BOS, Blue-IIN, Black-HBB, Black-#803, Black-EB, and Black-EX available from Orient Chemical Industries Ltd.; Sumiplast Series available from Sumitomo Chemical Industries Ltd., such as Sumiplast Blue-GP, Blue-OR, Red-FB, Red-3B, Yellow-FL7G, and Yellow-GC; and Kayaron Polyester Black EX-SF300, and Kayaset Red B, Blue-A-2R and the like available from Nippon Kayaku Co., Ltd.

According to the present invention, a magnetic substance can be employed as a colorant to give a magnetic toner.

As a polymerization initiator used according to the present invention, any known conventional polymerization initiator can be used. Examples of such a polymerization initiator include, for example, as a free-radical polymerization initiator, an azo type or diazo type polymerization initiator such as 2,2'-azobis-(2,4-dimethylvaleronitrile), 2,2'-azobisisobutyronitrile, 1,1'-azobis-(cyclohexane-1-carbonitrile), and 2,2'-azobis-4-methoxy 2,4-dimethyl valeronitrile, an amidine compound such as 2,2'-azobis(2-aminodipropane)dihydrochloride, 2,2'-azobis(N,N'-dimethylene isobutyl amidine), and 2,2'-azobis(N,N'-dimethylene isobutyl amidine) dihydrochloride; a peroxide type polymerization initiator such as benzoyl peroxide, methyl ethyl ketone peroxide, diisopropyl peroxy carbonate, cumene hydroperoxide, 2,4-dichlorobenzoyl peroxide, and lauroyl peroxide; and persulfate type initiators such as potassium persulfate and ammonium persulfate; and a mixture of the above-mentioned initiators.

Examples of an initiator for anionic polymerization include strong alkalis such as $SrR_2$, $CaR_2$, K, KR, Na, NaR, Li, LiR, ketyl, R-MgR, R-ONa, R-OK, R-OLi, sodium hydroxide, and potassium hydroxide; weak alkalis such as pyridine and ammonia; and R—O—R, (wherein R represents an alkyl group) and water.

Examples of an initiator for cationic polymerization include, for example, $SnCl_4$, $BF_3$, $ArCl_3$, and $TiCl_3$.

A known chain transfer agent can also be added according to the present invention. Examples thereof include, for example, halogenated hydrocarbons such as carbon tetrachloride, carbon tetrabromide, ethyl acetate dibromide, ethyl acetate tribromide, ethyl benzene dibromide, ethane dibromide, and ethane dichloride; hydrocarbons such as diazothioether, benzene, ethyl benzene, and isopropyl benzene; mercaptans such as tertiary dodecyl mercaptan, and n-dodecyl mercaptan, and disulfides such as diisopropyl xanthogen disulphide.

A charge controlling agent can also be added to the toner of the present invention in order to control the charge characteristics. As the charge controlling agent, both positive charge controlling agents and negative charge controlling agents which are usually used for a toner can be used. Examples thereof include a nigrosine type dye, a triphenyl methane type dye, a quaternary ammonium salt, an amine type or imine type compound, a metal compound of salicylic acid or alkyl salicylic acid, a monoazo type dye containing a metal, a compound having carboxylyl group or sulfoxyl group, humic acids and salts of humic acid. According to the present invention, it is preferable to use a negative charge controlling agent for improving the stability of the toner to changing environments.

Various external additives can be added to the toner of the present invention in order to improve the fluidity and charge characteristics. Any external additive which is usually employed for a toner can be used. Examples thereof include, for example, silica, titanium oxide, and alumina particulates. An external additive which can be preferably used has a BET specific surface area of not less than 300 $m^2/g$. The use of those having a BET specific surface area of less than 300 $m^2/g$ is possible. However, those external additives of not less than 300 $m^2/g$ are important to maintain homogeneous surface condition of the toner which has a fine particle diameter and a sharp particle size distribution, and to carry out satisfactory charging of the toner.

The toner of the present invention can be mixed with carrier particles and employed as a two-component type developer. As the carrier, those which are conventionally employed can be used, such as an iron powder carrier, magnetite carrier, ferrite carrier, and magnetic-substance-dispersed-resin carrier. For imparting sufficient charge quantity to the toner, the number average particle diameter thereof is usually up to 35 $\mu$m.

Measuring methods employed according to the present invention will be explained.

1) Determination of a Methanol-soluble Resin Component Extracted by Methanol

The extraction and quantitative determination of the methanol-soluble resin component extracted by methanol were carried out as follows.

30 g of a sample (toner particles or a toner) were accurately weighed (w1) and added to a 1 l round flask and 600 g of methanol of reagent grade was added thereto. The flask was set in a rotary evaporator (R-144, manufactured by Shibata Kagaku Kiki Kogyo Co., Ltd.) and agitated at 250 rpm for 24 hours on a water bath kept at 25° C.

Then, the dispersion of the sample was centrifuged at 5000 rpm for 1 hour by a centrifugal separator (Himac CR26H, manufactured by Hitachi Koki Co., Ltd.) and the solid content was thoroughly sedimented and the extract was taken out by decantation. The extract was added to an accurately weighed round flask (w2) and the methanol was removed by evaporation under a reduced pressure using the above-mentioned rotary evaporator on a water bath kept at 35° C. When all the methanol was evaporated, the weight of the flask (w3) was accurately measured and the amount of the methanol-soluble resin component extracted by methanol was calculated according to the following equation. The methanol-soluble resin component extracted by methanol (wt %)=$\{(w3-w2)/w1\}\times 100$ 2) Composition Analysis of the Polymer Composition Having an Organic Acid Group The composition analysis of the methanol soluble resin component extracted by methanol is carried out by obtaining the ratio of each repeating unit in molar ratio, by the measurement of 1H-NMR and 13C-NMR (nuclear magnetic resonance) spectra.

(1H-NMR)

Measuring apparatus: FT NMR apparatus JNM-EX400 (manufactured by JEOL Ltd.)

Measuring frequency: 400 MHz

Pulse condition: 5.0 $\mu$s

Data points: 32768

Frequency width: 10500 Hz

Integration times: 16 times

Measuring temperature: 40° C.

Sample: 200 mg of a test sample was put in a sample tube having a diameter of 5 mm, and deuterated methanol $CD_3OD$(Tetramethylsilane (TMS) 0.05%) was added thereto as a solvent to dissolve the test sample in a thermostatic chamber at 40° C.

(13C-NMR)

Measuring apparatus: FT NMR apparatus JNM-EX400 (manufactured by JEOL Ltd.)

Measuring frequency: 400 MHz

Pulse condition: 5.0 $\mu$s

Data points: 32768

Frequency width: 10500 Hz

Integration times: 10,000 times

Measuring temperature: 40° C.

Sample: 200 mg of a test sample were put in a sample tube having a diameter of 5 mm, and deuterated methanol $CD_3OD$(Tetramethylsilane (TMS) 0.05%) was added thereto as a solvent to dissolve the test sample in a thermostatic chamber at 40° C.

3) Measurement of an Acid Value of a Methanol-soluble Resin Component Extracted by Methanol Measurement of an acid value of a methanol-soluble resin component extracted by methanol is carried out as follows; About 0.5 g of a sample (W) is accurately weighed and added to a 200 ml beaker. Then, 150 ml of toluene/methanol (7:3) mixed solution is added thereto to dissolve the sample.

The solution in the beaker is titrated using potentiometric titration employing 1/10N KOH ethanol solution. The titration apparatus employed is AT-400 win workstation available from Kyoto Denshi Kogyo Co., Ltd. and automatically titrated by APB-410, an electric burette. The amount of the KOH solution used is noted as S (ml). A blank test is concurrently carried out and the amount of the KOH solution used in the blank test is noted as B (ml). From these data, an acid value is obtained according to the following equation.

$$\text{Acid value (mgKOH/g)}=(S-B)\times f\times 5.61/W$$

f: factor of KOH solution

4) Measurement of the Molecular Weight Distribution

Measurement of the molecular weight distribution of the methanol soluble resin component according to the present invention is carried out by GPC measuring apparatus (HLC-8120GPC, manufactured by Tosoh Corporation.)

Measuring Conditions

Column: TSKgel HM-M (6.0×15 cm) double columns

Temperature: 40° C.

Solvent: THF

Flow rate: 0.6 ml/min

Detector: RI

Sample concentration: A sample of 0.1% in an amount of 10 μl

Test sample is prepared as follows; a sample is put in THF, and left to stand for several hours, then thoroughly shaken so as to be well mixed with the THF (until coalescent matters of the sample disappear), which is further left to stand for 12 hours. Thereafter, the solution is passed through a sample-treating filter (pore size: 0.45 μm) and used as the sample for GPC.

As the calibration curve, a molecular weight calibration curve prepared with monodisperse polystyrene standard samples is employed. Molecular weight maximum value is obtained from the resulting logarithmic curve (log M). Then, from the cumulative curve from the molecular weight of 200 to the molecular weight of 1000, the amount of a low molecular weight component included in the toner resin is calculated.

5) Measurement of a Particle Diameter of the Toner Particle and the Toner

The measurement of the particle diameter of the toner particle and the toner employed according to the present invention is carried out within a range of from 0.4 μm to 60 μm, by laser scan type particle size distribution measuring apparatus (CIS-100, available from GALAI Co., Ltd.) for the toner having an average particle diameter of 1 μm or more. The sample is prepared as follows; 0.2 ml of a surfactant (an alkylbenzene sulphonate) is added to 100 ml of water and 0.5–2 mg of a toner are added thereto and dispersed by ultrasonic disperser for 2 minutes, then 1 or 2 drops of the resulting sample are added to a cubic cell filled with water to nearly 80% containing a magnet stirrer. The Dn and SD (standard deviation) obtained therefrom are used to calculate the number average particle diameter and the coefficient of variation.

For a case in which the average particle diameter is less than 1 μm, a scanning electron microscopic photograph (×10,000) is taken by a scanning electron microscope (FE-SEM S-800 manufactured by Hitachi, Ltd.) and based on the photograph, the Feret diameter in the horizontal direction of those particles having the Feret diameter in the horizontal direction of not less than 0.1 μm, is measured for not less than 300 particles. And the average thereof is calculated as a number average particle diameter. By the use of the measured values, the standard deviation is calculated to give the coefficient of variation.

6) Measurement of the Triboelectric Charge Quantity

A method of measuring the triboelectric charge quantity employed according to the present invention will be described. A sample (toner particles or a toner) for measurement of the triboelectric charge quantity is added to a carrier such that the toner concentration becomes 7% by weight, and they are mixed by a tumbler mixer for 180 seconds. The mixed powder (developing agent) is added to a metal container wherein a conductive screen of 635 mesh is installed at the bottom, then aspirated by an aspirator and the triboelectric charge quantity is obtained from the difference in weight before and after the aspiration and the electric potential accumulated in the condenser which is connected to the container. In this case, the aspiration pressure is set to 250 mmHg. In this method, the triboelectric charge quantity is calculated according to the following equation.

$$Q/M(\mu C/g)=(C\times V)/(W1-W2)$$

(wherein W1 is the weight prior to the aspiration, W2 is the weight after the aspiration, C is capacity of the condenser, and V is the electric potential accumulated in the condenser.)

The present invention will be explained with the following Examples. The present invention is not be limited by the illustrative Examples which follow.

EXAMPLE 1

A mixture was formed as follows:

| | |
|---|---|
| Methanol | 270 parts by weight |
| Styrene-α-methylstyrene-acrylic acid-methacrylic acid copolymer (copolymerization composition ratio = 1:1:1:2, weight average molecular weight = 49,600, acid value = 382 mgKOH/g) | 30 parts by weight |
| Styrene | 80 parts by weight |
| n-butyl acrylate | 20 parts by weight |
| 2,2'-azobisisobutylonitrile | 4.5 parts by weight |
| copper phthalocyanine blue | 6 parts by weight |

The mixture was added to a reaction vessel and well mixed at a room temperature for 30 minutes while nitrogen was bubbled in at 400 ml/min. The amount of the dissolved oxygen measured at the start of the polymerization was 0.3 mg/l. Then the temperature of an oil bath was set to 72° C. and the mixture was refluxed for 12 hours under nitrogen atmosphere.

After the dispersion was cooled to a room temperature, solid/liquid separation and cleaning of the dispersion were repeatedly carried out. For cleaning, a solvent comprising 80% by weight of methanol and 20% by weight of water was employed. After a total of four cleaning cycles were carried out, the slurry was washed with water and dried to give toner particles having a number average particle diameter (Dn) of 4.60 μm, and the coefficient of variation of number distribution of 13.4%.

The toner particles were extracted with methanol for 24 hours, and the ratio of the resin component extracted by methanol was 2.1% by weight of the toner particles.

The acid value (Av) of the methanol-soluble resin component extracted by methanol was measured and found to be 361 mgKOH/g. The weight average molecular weight (Mw) of the resin component measured was 51,200, and the component having a molecular weight of from 200 to 1000 was in an amount of 0.5% by weight of the toner particles. The number of the units of the repeating units (I) and (II) was respectively 55.7% and 39.4% based on the units constituting the entire methanol-soluble resin component and the ratio of the number of the units of the repeating unit (I) to the total number of the repeating units (I) and (II) was 58.6%.

The physical properties of the toner particles are given in Table 1.

100 parts by weight of the obtained toner particles were mixed with 1.5 parts by weight of crushed silica having a BET value of 380 $m^2/g$ by Henschel mixer and added externally. The physical properties of the obtained toner are given in Table 2.

7 parts by weight of this toner, and 93 parts by weight of a carrier comprising ferrite core having an average particle diameter of 30 $\mu$m coated with silicone resin were mixed and a developing agent was prepared.

The produced developing agent was used and measurement of the triboelectric charge quantity was carried out under different environments, i.e. under low temperature and low humidity (L/L:15° C./10%), normal temperature and normal humidity (N/N: 23.5° C./60%), and high temperature and high humidity (H/H: 30° C./80%) respectively. As a result, the triboelectric charge quantity under L/L was −41.1 $\mu$C/g, that under N/N was −40.6 $\mu$C/g, and that under H/H was −39.8 $\mu$C/g, and the developing agent showed excellent environmental stability.

The developing agent was loaded in a modified machine of a full-color laser copier CLC-500 manufactured by Canon Inc.(the surface of the developer carrying member was so roughened that the surface roughness became Rz=10 $\mu$m, and the laser spot diameter was reduced by 20% in order to exactly evaluate the halftone reproducibility) and the solid picture image and halftone picture image by minimal spot were formed, and each picture image was evaluated under L/L, N/N and H/H environments.

Evaluation of reproducibility of the halftone formed by the minimal spot was done by carrying out multi-valued recording, by pulse width modulation (PWM) of the laser within one pixel, then observing the surface of the photosensitive drum microscopically, thereby evaluating the reproducibility of the toner to the minimal spot according to the following evaluation criteria.

(Evaluation Criteria)

A: Very good; no disarrangement in the dots; even the smallest dot can be reproduced.

B: Slight variations in the dot form, but no spattering occurs.

C: Spattering and some variations in the dot form are found.

D: Spattering and variations in the dot form are observed insignificant amounts.

E: Dots are not developed where they should be, or too much spattering is found.

For evaluating fogging, fog concentration (%) was calculated from the difference between the whiteness degree of the white part of a printed out image and the whiteness degree of the transfer paper, which was measured by 'Reflectometer' (manufactured by Tokyo Denshokusha Co., Ltd.) and fogging was evaluated according to the following evaluation criteria.

(Evaluation Criteria)

A: less than 0.5%

B: 0.5% or more and less than 1.0%

C: 1.0% or more and less than 2.0%

D: 2.0% or more and less than 4.0%

E: 4.0% or more

The results are shown in Table 3. In all the environments, the image density of the solid picture image was high, occurring of fogging was well controlled and the reproducibility of the halftone was good.

EXAMPLE 2

A mixture was formed of:

| | |
|---|---|
| Methanol | 270 parts by weight |
| Styrene-α-methylstyrene-acrylic acid copolymer (copolymerization composition ratio = 1:1:2, weight average molecular weight = 52,000, acid value = 335 mgKOH/g) | 30 parts by weight |
| Styrene | 80 parts by weight |
| n-butyl acrylate | 20 parts by weight |
| 2,2'-azobisisobutylonitrile | 4.5 parts by weight |
| copper phthalocyanine blue | 6 parts by weight |

The mixture was added to a reaction vessel and mixed well for 30 minutes while nitrogen was bubbled in at 400 ml/min. The amount of the dissolved oxygen measured at the start of the polymerization was 0.3 mg/l. Then polymerization was carried out and cleaning was repeated in a process analogous to that of Example 1 to give particles. The obtained slurry was dried to give toner particles having a number average particle diameter (Dn) of 4.58 $\mu$m, and the coefficient of variation of number distribution of 15.9%.

The toner particles were extracted with a methanol solution for 24 hours, and the ratio of the resin component extracted by methanol was 2.2% by weight of the toner particles.

The acid value and GPC molecular weight distribution of the solvent soluble resin component extracted by methanol were measured in a process analogous to that of Example 1, and the acid value was 317 mgKOH/g, and the weight average molecular weight of the resin component was 53,300, and the component having a molecular weight of from 200 to 1000 was in an amount of 0.6% by weight of the toner particles. Regarding the repeating units (I) and (II), see Table 1.

Then, silica was externally added in a process analogous to that of Example 1. The physical properties of the obtained toner particles are given in Table 2.

A developing agent was prepared from the obtained toner in a process analogous to that of Example 1 and the charge quantity was measured. The result was L/L:−43.2 $\mu$C/g, N/N:−40.8 $\mu$C/g, and H/H:−38.5 $\mu$C/g.

Picture image evaluation under L/L, N/N and H/H environments was carried out in a process analogous to that of Example 1. The results are given in Table 3. Good results were obtained similar to those of Example 1.

EXAMPLE 3

A mixture was formed of:

| | |
|---|---|
| Methanol | 265 parts by weight |
| Styrene-α-methylstyrene-acrylic acid copolymer (copolymerization composition ratio = 2:1:1, weight average molecular weight = 34,400, acid value = 176 mgKOH/g) | 35 parts by weight |
| Styrene | 80 parts by weight |
| n-butyl acrylate | 20 parts by weight |
| 2,2'-azobisisobutylonitrile | 4.5 parts by weight |
| copper phthalocyanine blue | 6 parts by weight |

The mixture was added to a reaction vessel and mixed well for 30 minutes while nitrogen was bubbled in at 400 ml/min. The amount of the dissolved oxygen at the start of the polymerization measured was 0.3 mg/l. Then, polymerization was carried out and cleaning was repeated in a process analogous to that of Example 1 to give particles. The obtained slurry was dried to give toner particles having a number average particle diameter (Dn) of 4.49 μm, and the coefficient of variation of number distribution of 17.2%.

The toner particles were extracted with a methanol solution for 24 hours, and the ratio of the resin component extracted by methanol was 2.8% by weight of the toner particles.

The acid value and GPC molecular weight distribution of the solvent soluble resin component extracted by methanol were measured in a process analogous to that of Example 1, and the acid value was 154 mgKOH/g, and the weight average molecular weight of the resin component was 35,600, and the component having a molecular weight of from 200 to 1000 was in an amount of 0.6% by weight of the toner particles. Regarding the repeating units (I) and (II), see Table 1.

Then silica was externally added in a process analogous to that of Example 1. The physical properties of the obtained toner particles are given in Table 2.

A developing agent was prepared in a process analogous to that of Example 1 and the charge quantity was measured. The result was L/L:−44.6 μC/g, N/N:−40.5 μC/g, and H/H:−37.8 μC/g.

Picture image evaluation under L/L, N/N and H/H environments was carried out in a process analogous to that of Example 1.

The results are given in Table 3. The results were good, though they were inferior to those of Example 1.

EXAMPLE 4

A mixture was formed of:

| | |
|---|---|
| Methanol | 270 parts by weight |
| Styrene-α-methylstyrene-acrylic acid-methacrylic acid copolymer (copolymerization composition ratio = 1:1:3:2, weight average molecular weight = 52,200, acid value = 451 mgKOH/g) | 30 parts by weight |
| Styrene | 80 parts by weight |
| n-butyl acrylate | 20 parts by weight |
| 2,2'-azobisisovaleronitrile | 4.5 parts by weight |
| copper phthalocyanine blue | 6 parts by weight |

The mixture was added to a reaction vessel and mixed well for 30 minutes while nitrogen was bubbled in at 400 ml/min. The amount of the dissolved oxygen measured at the start of the polymerization was 0.5 mg/l. Then polymerization was carried out and cleaning was repeated in a process analogous to that of Example 1 to give particles. The obtained slurry was dried to give toner particles having a number average particle diameter (Dn) of 4.62 μm, and the coefficient of variation of number distribution of 17.1%.

The toner particles were extracted with a methanol solution for 24 hours, and the ratio of the resin component extracted by methanol was 2.2% by weight of the toner particles.

The acid value and GPC molecular weight distribution of the solvent soluble resin component extracted by methanol were measured in a process analogous to that of Example 1, and the acid value was 425 mgKOH/g, and the weight average molecular weight of the resin component was 52,900, and the component having a molecular weight of from 200 to 1000 was in an amount of 0.5% by weight of the toner particles. Regarding the repeating units (I) and (II), see Table 1.

Then silica was externally added in a process analogous to that of Example 1. The physical properties of the obtained toner particles are given in Table 2.

A developing agent was prepared in a process analogous to that of Example 1 and the charge quantity was measured. The result was L/L:−43.8 μC/g, N/N:−40.3 μC/g, and H/H:−37.4 μC/g.

Picture image evaluation under L/L, N/N and H/H environments was carried out in a process analogous to that of Example 1.

The results are given in Table 3. The results were good, though they were inferior to those of Example 1.

EXAMPLE 5

A mixture was formed of:

| | |
|---|---|
| Methanol | 260 parts by weight |
| Styrene-α-methylstyrene-acrylic acid-methacrylic acid copolymer (copolymerization composition ratio = 1:1:1:2, weight average molecular weight = 49,600, acid value = 382 mgKOH/g) | 15 parts by weight |
| Styrene | 80 parts by weight |
| n-butyl acrylate | 20 parts by weight |
| 2,2'-azobisisobutyronitrile | 5.5 parts by weight |
| copper phthalocyanine blue | 6 parts by weight |

This mixture was added to a reaction vessel and mixed well for 30 minutes while nitrogen was bubbled in at 400 ml/min. The amount of the dissolved oxygen measured at the start of the polymerization was 0.3 mg/l. Then particles were obtained in a process analogous to that of Example 1. The obtained slurry was dried to give toner particles having a number average particle diameter (Dn) of 5.89 μm, and the coefficient of variation of number distribution of 15.5%.

The toner particles were extracted with a methanol solution for 24 hours, and the ratio of the resin component extracted by methanol was 2.4% by weight of the toner particles.

The acid value and GPC molecular weight distribution of the solvent soluble resin component extracted by methanol were measured in a process analogous to that of Example 1, and the acid value was 340 mgKOH/g, and the weight average molecular weight of the resin component was 50,700, and the component having a molecular weight of from 200 to 1000 was in an amount of 0.6% by weight of the toner particles. Regarding the repeating units (I) and (II), see Table 1.

Then silica was externally added in a process analogous to that of Example 1, except that the amount of silica added was 1.0 part by weight. The physical properties of the obtained toner particles are given in Table 2.

A developing agent was prepared in a process analogous to that of Example 1 and the charge quantity was measured. The result was L/L:−34.1 μC/g, N/N:−32.4 μC/g, and H/H:−30.6 μC/g.

Picture image evaluation under L/L, N/N and H/H environments was carried out in a process analogous to that of Example 1.

The results are given in Table 3. The results showed that the charge quantity was lower than that of Example 1 and the halftone reproducibility was inferior, too.

EXAMPLE 6

A mixture was formed of:

| | |
|---|---|
| Methanol | 200 parts by weight |
| Ethanol | 60 parts by weight |
| Styrene-α-methylstyrene-acrylic acid-methacrylic acid copolymer (copolymerization composition ratio = 1:1:1:2, weight average molecular weight = 49,600, acid value = 382 mgKOH/g) | 40 parts by weight |
| Styrene | 80 parts by weight |
| n-butyl acrylate | 20 parts by weight |
| 2,2'-azobisisobutyronitrile | 4.0 parts by weight |
| copper phthalocyanine blue | 6 parts by weight |

This mixture was added to a reaction vessel and mixed well for 30 minutes while nitrogen was bubbled in at 400 ml/min. The amount of the dissolved oxygen measured at the start of the polymerization was 0.3 mg/l. Then particles were obtained in a process analogous to that of Example 1, except that the solvent for cleaning was changed to a mixture of methanol in an amount of 60% by weight and water in an amount of 40% by weight. The obtained slurry was dried to give toner particles having a number average particle diameter (Dn) of 1.41 μm, and the coefficient of variation of number distribution of 8.6%.

The toner particles were extracted with a methanol solution for 24 hours, and the ratio of the resin component extracted by methanol was 3.6% by weight of the toner particles.

The acid value and GPC molecular weight distribution of the solvent soluble resin component extracted by methanol were measured in a process analogous to that of Example 1, and the acid value was 348 mgKOH/g, and the weight average molecular weight of the resin component was 50,900, and the component having a molecular weight of from 200 to 1000 was in an amount of 0.4% by weight of the toner particles. Regarding the repeating units (I) and (II), see Table 1.

Then silica was externally added in a process analogous to that of Example 1, except that the amount of the silica added was 4.5 parts by weight. The physical properties of the obtained toner particles are given in Table 2.

A developing agent was prepared in a process analogous to that of Example 1 and the charge quantity was measured. The result was L/L:−48.3 μC/g, N/N:−45.2 μC/g, and H/H:−39.7 μC/g.

Picture image evaluation under L/L, N/N and H/H environments was carried out in a process analogous to that of Example 1.

The results are given in Table 3. The results were good as those of Example 1, though some fogging was observed.

EXAMPLE 7

A mixture was formed of:

| | |
|---|---|
| Methanol | 265 parts by weight |
| Styrene-α-methylstyrene-acrylic acid-ethyl acrylate copolymer (copolymerization composition ratio = 5:1:3:1, weight average molecular weight = 27,000, acid value = 198 mgKOH/g) | 35 parts by weight |
| Styrene | 80 parts by weight |
| n-butyl acrylate | 20 parts by weight |
| 2,2'-azobis(2,4-dimethylvaleronitrile) | 4.2 parts by weight |
| copper phthalocyanine blue | 6 parts by weight |

This mixture was added to a reaction vessel and the slurry solution was circulated at a room temperature for 10 minutes using a circulating type ultrasonic disperser, then mixed well for 30 minutes while nitrogen was bubbled in at 400 ml/min. The amount of the dissolved oxygen measured at the start of the polymerization was 0.1 mg/l. Then the temperature of an oil bath was set to 72° C. and the slurry was refluxed for 12 hours under nitrogen atmosphere.

After the dispersion was cooled to a room temperature, the solid/liquid separation and cleaning of the dispersion were repeatedly carried out. For cleaning, a cleaning solvent comprising 50% by weight of methanol and 50% by weight of water was employed. When a total of three cleaning cycles were carried out, the slurry was washed with water and dried to give toner particles having a number average particle diameter (Dn) of 3.34 μm, and the coefficient of variation of number distribution of 10.8%

The toner particles were extracted with a methanol solution for 24 hours, and the ratio of the resin component extracted by methanol was 5.1% by weight of the toner particles.

The acid value and GPC molecular weight distribution of the solvent soluble resin component extracted by methanol were measured in a process analogous to that of Example 1, and the acid value was 192 mgKOH/g, and the weight average molecular weight of the resin component was 30,100, and the component having a molecular weight of from 200 to 1000 was in an amount of 0.3% by weight of the toner particles. Regarding the repeating units (I) and (II), see Table 1.

Then silica was externally added in a process analogous to that of Example 1 except that the amount of the silica added was 2.0 parts by weight. The physical properties of the obtained toner particles are given in Table 2.

A developing agent was prepared in a process analogous to that of Example 1 and the charge quantity was measured. The result was L/L:−43.5 μC/g, N/N:−38.4 μC/g, and H/H:−35.1 μC/g.

Picture image evaluation under L/L, N/N and H/H environments was carried out in a process analogous to that of Example 1.

The results are given in Table 3. The results were extremely good.

EXAMPLE 8

The mixture employed in Example 7 was added to a reaction vessel in a process analogous to that of Example 1 and well mixed for 20 minutes while nitrogen was bubbled in at 400 ml/min. The amount of the dissolved oxygen measured at the start of the polymerization was 0.8 mg/l. Then particles were obtained in a process analogous to that of Example 7. The obtained slurry was dried to give toner particles having a number average particle diameter (Dn) of 3.50 μm, and the coefficient of variation of number distribution of 15.4%.

The toner particles were extracted with a methanol solution for 24 hours, and the ratio of the resin component extracted by methanol was 4.8% by weight of the toner particles.

The acid value and GPC molecular weight distribution of the methanol soluble resin component extracted by methanol were measured in a process analogous to that of Example 1, and the acid value was 123 mgKOH/g, and the weight average molecular weight of the resin component was 43,800, and the component having a molecular weight of from 200 to 1000 was in an amount of 0.9% by weight of the toner particles. Regarding the repeating units (I) and (II), see Table 1.

Then silica was externally added in a process analogous to that of Example 7. The physical properties of the obtained toner particles are given in Table 2.

A developing agent was prepared in a process analogous to that of Example 1 and the charge quantity was measured. The result was L/L:−43.2 μC/g, N/N:−38.1 μC/g, and H/H:−35.3 μC/g.

Picture image evaluation under L/L, N/N and H/H environments was carried out in a process analogous to that of Example 1.

The results are given in Table 3. Good results were obtained as those of Example 1.

EXAMPLE 9

The mixture employed in Example 7 was added to a reaction vessel in a process analogous to that of Example 1 and mixed well for 15 minutes while nitrogen was bubbled in at 400 ml/min. The amount of the dissolved oxygen measured at the start of the polymerization was 1.9 mg/l. Then particles were obtained in a process analogous to that of Example 7. The obtained slurry was dried to give toner particles having a number average particle diameter (Dn) of 3.47 μm, and the coefficient of variation of number distribution of 19.7%.

The toner particles were extracted with a methanol solution for 24 hours, and the ratio of the resin component extracted by methanol was 4.3% by weight of the toner particles.

The acid value and GPC molecular weight distribution of the solvent soluble resin component extracted by methanol were measured in a process analogous to that of Example 1, and the acid value was 118 mgKOH/g, and the weight average molecular weight of the resin component was 43,100, and the component having a molecular weight of from 200 to 1000 was in an amount of 1.6% by weight of the toner particles. Regarding the repeating units (I) and (II), see Table 1.

Then silica was externally added in a process analogous to that of Example 7. The physical properties of the obtained toner particles are given in Table 2.

A developing agent was prepared in a process analogous to that of Example 1 and the charge quantity was measured. The result was L/L:−44.4 μC/g, N/N:−38.3 μC/g, and H/H:−34.5 μC/g.

Picture image evaluation under L/L, N/N and H/H environments was carried out in a process analogous to that of Example 1.

The results are given in Table 3. Good results were obtained, as those of Example 1.

EXAMPLE 10

A mixture was formed of:

| | |
|---|---|
| Methanol | 235 parts by weight |
| Water | 30 parts by weight |
| Styrene-α-methylstyrene-acrylic acid-ethyl acrylate copolymer (copolymerization composition ratio = 5:1:3:1, weight average molecular weight = 27,000, acid value = 198 mgKOH/g) | 35 parts by weight |
| Styrene | 80 parts by weight |
| n-butyl acrylate | 20 parts by weight |
| 2,2'-azobisisobutyronitrile | 4.5 parts by weight |
| copper phthalocyanine blue | 6 parts by weight |

This mixture was added to a reaction vessel and mixed well for 30 minutes while nitrogen was bubbled in at 400 ml/min. The amount of the dissolved oxygen measured at the start of the polymerization was 0.3 mg/l. Then the temperature of an oil bath was set to 72° C. and the mixture was refluxed for 12 hours under nitrogen atmosphere.

After the dispersion was cooled to a room temperature, solid/liquid separation and cleaning of the dispersion were repeatedly carried out. For cleaning, a cleaning solvent comprising 50% by weight of methanol and 50% by weight of water was employed. When a total of three cleaning cycles were repeatedly carried out, the slurry was washed with water and dried to give toner particles having a number average particle diameter (Dn) of 3.47 μm, and the coefficient of variation of number distribution of 15.6%.

The toner particles were extracted with a methanol solution for 24 hours, and the ratio of the resin component extracted by methanol was 8.7% by weight of the toner particles.

The acid value and GPC molecular weight distribution of the methanol soluble resin component extracted by methanol were measured in a process analogous to that of Example 1, and the acid value was 205 mgKOH/g, and the weight average molecular weight of the resin component was 29,000, and the component having a molecular weight of from 200 to 1000 was in an amount of 0.8% by weight of the toner particles. Regarding the repeating units (I) and (II), see Table 1.

Then silica was externally added in a process analogous to that of Example 7. The physical properties of the obtained toner particles are given in Table 2.

A developing agent was prepared in a process analogous to that of Example 1 and the charge quantity was measured. The result was L/L:−43.3 μC/g, N/N:−38.4 μC/g, and H/H:−32.9 μC/g.

Picture image evaluation under L/L, N/N and H/H environments was carried out in a process analogous to that of Example 1.

The results are given in Table 3. Good results were obtained similar to those of Example 1.

EXAMPLE 11

The mixture employed in Example 1 was added to a reaction vessel in a process analogous to that of Example 1 and mixed well for 30 minutes while nitrogen was bubbled in at 400 ml/min. The amount of the dissolved oxygen measured at the start of the polymerization was 0.3 mg/l. Then the temperature of an oil bath was set to 72° C. and the mixture was refluxed for 12 hours under nitrogen atmosphere.

After the dispersion was cooled to a room temperature, the solid/liquid separation and cleaning of the dispersion were repeatedly carried out. As a cleaning solvent, methanol was employed. When a total of four cleaning cycles were carried out, the slurry was further washed with water twice and the obtained slurry was dried to give toner particles having a number average particle diameter (Dn) of 4.58 μm, and the coefficient of variation of number distribution of 14.7%.

The toner particles were extracted with a methanol solution for 24 hours, and the ratio of the resin component extracted by methanol was 0.1% by weight of the toner particles.

The acid value and GPC molecular weight distribution of the solvent soluble resin component extracted by methanol were measured in a process analogous to that of Example 1, the acid value was 347 mgKOH/g, and the weight average molecular weight of the resin component was 51,300, and the component having a molecular weight of from 200 to 1000 was in an amount of 0.2% by weight of the toner particles. Regarding the repeating units (I) and (II), see Table 1.

Then silica was externally added in a process analogous to that of Example 1. The physical properties of the obtained toner particles are given in Table 2.

A developing agent was prepared in a process analogous to that of Example 1 and the charge quantity was measured. The result was L/L:−49.5 μC/g, N/N:−40.3 μC/g, and H/H:−35.8 μC/g.

Picture image evaluation under L/L, N/N and H/H environments was carried out in a process analogous to that of Example 1.

The results are given in Table 3. The results were good, though they were inferior to those of Example 1.

EXAMPLE 12

The mixture employed in Example 1 was added to a reaction vessel in a process analogous to that of Example 1 and mixed well for 30 minutes while nitrogen was bubbled in at 400 ml/min. The amount of the dissolved oxygen measured at the start of the polymerization was 0.3 mg/l. Then the temperature of an oil bath was set to 72° C. and the mixture was refluxed for 12 hours under nitrogen atmosphere.

After the dispersion was cooled to a room temperature, the solid/liquid separation and cleaning of the dispersion were repeatedly carried out. As a cleaning solvent, a solvent comprising 50% by weight of methanol and 50% by weight of water was employed. When a total of two cleaning cycles were repeatedly carried out, the slurry was further washed with water and the obtained slurry was dried to give toner particles having a number average particle diameter (Dn) of 4.61 μm, and the coefficient of variation of number distribution of 14.2%.

The toner particles were extracted with a methanol solution for 24 hours, and the ratio of the resin component extracted by methanol was 9.5% by weight of the toner particles.

The acid value and GPC molecular weight distribution of the methanol soluble resin component extracted by methanol were measured in a process analogous to that of Example 1, and the acid value was 369 mgKOH/g, and the weight average molecular weight of the resin component was 51,100, and the component having a molecular weight of from 200 to 1000 was in an amount of 1.1% by weight of the toner particles. Regarding the repeating units (I) and (II), see Table 1.

Then silica was externally added in a process analogous to that of Example 1. The physical properties of the obtained toner particles are given in Table 2.

A developing agent was prepared in a process analogous to that of Example 1 and the charge quantity was measured. The result was L/L:−43.2 μC/g, N/N:−39.7 μC/g, and H/H:−31.7 μC/g.

Picture image evaluation under L/L, N/N and H/H environments was carried out in a process analogous to that of Example 1.

The results are given in Table 3. The results were good, though they were inferior to those of Example 1.

Comparative Example 1

A mixture was formed of:

| | |
|---|---|
| Methanol | 270 parts by weight |
| Styrene-acrylic acid copolymer (copolymerization composition ratio = 1:9, weight average molecular weight = 55,000, acid value = 664 mgKOH/g) | 30 parts by weight |
| Styrene | 80 parts by weight |
| n-butyl acrylate | 20 parts by weight |
| 2,2'-azobisisobutyronitrile | 4.5 parts by weight |
| copper phthalocyanine blue | 6 parts by weight |

This mixture was added to a reaction vessel and mixed well for 15 minutes while nitrogen was bubbled in at 400 ml/min. The amount of the dissolved oxygen measured at the start of the polymerization was 1.8 mg/l. Then particles were obtained in a process analogous to that of Example 1. The obtained slurry was dried to give toner particles having a number average particle diameter (Dn) of 4.63 μm, and the coefficient of variation of number distribution of 18.3%.

The toner particles were extracted with a methanol solution for 24 hours, and the ratio of the resin component extracted by methanol was 4.7% by weight of the toner particles.

The acid value and GPC molecular weight distribution of the resin component extracted by methanol were measured in a process analogous to that of Example 1, and the acid value was 624 mgKOH/g, and the weight average molecular weight of the resin component was 55,800, and the component having a molecular weight of from 200 to 1000 was in an amount of 1.5% by weight of the toner particles. Regarding the repeating units (I) and (II), see Table 1.

Then silica was externally added in a process analogous to that of Example 1. The physical properties of the obtained toner particles are given in Table 2.

A developing agent was prepared from the obtained toner in a process analogous to that of Example 1 and the charge quantity was measured. The result was L/L:−45.3 μC/g, N/N:−39.7 μC/g, and H/H:−36.1 μC/g. The difference in the charge quantity under different environments was very significant.

Picture image evaluation under L/L, N/N and H/H environments was carried out in a process analogous to that of Example 1.

The results are given in Table 3. The results showed that under a high temperature and high humidity condition, the image density was high, however severe fogging was observed.

Comparative Example 2

A mixture was formed of:

| | |
|---|---|
| Methanol | 270 parts by weight |
| Ethyl acrylate-acrylic acid copolymer (copolymerization composition ratio = 9:1, weight average molecular weight = 10,300, acid value = 45 mgKOH/g) | 30 parts by weight |
| Styrene | 80 parts by weight |
| n-butyl acrylate | 20 parts by weight |
| 2,2'-azobisisobutyronitrile | 4.5 parts by weight |
| copper phthalocyanine blue | 6 parts by weight |

This mixture was added to a reaction vessel and mixed well for 30 minutes while nitrogen was bubbled in at 400 ml/min. The amount of the dissolved oxygen measured at the start of the polymerization was 0.3 mg/l. Then particles were obtained in a process analogous to that of Example 1. The obtained slurry was dried to give toner particles having a number average particle diameter (Dn) of 4.55 μm, and the coefficient of variation of number distribution of 19.8%.

The toner particles were extracted with a methanol solution for 24 hours, and the ratio of the resin component extracted by methanol was 2.4% by weight of the toner particles.

The acid value and GPC molecular weight distribution of the resin component extracted by methanol were measured in a process analogous to that of Example 1, and the acid value was 39 mgKOH/g, and the weight average molecular weight of the resin component was 11,500, and the component having a molecular weight of from 200 to 1000 was in an amount of 8.4% by weight of the toner particles. Regarding the repeating units (I) and (II), see Table 1.

Then silica was externally added in a process analogous to that of Example 1. The physical properties of the obtained toner particles are given in Table 2.

A developing agent was prepared in a process analogous to that of Example 1 and the charge quantity was measured. The result was L/L:−53.2 μC/g, N/N:−38.1 μC/g, and H/H:−31.3 μC/g. The difference in the charge quantity under different environments was very large.

Picture image evaluation under L/L, N/N and H/H environments was carried out in a process analogous to that of Example 1.

The results are given in Table 3. The results showed that the reproducibility of the halftone was inferior.

Comparative Example 3

A solution was formed of

| | |
|---|---|
| Water | 600 parts by weight and |
| Polyvinyl alcohol (polymerization degree of 500, saponification degree of 87 mol %) | 1 part by weight |

The solution was added to a reaction vessel and a mixture was formed of

| | |
|---|---|
| Styrene-acrylic acid-butyl acrylate copolymer (copolymerization composition ratio = 4:1:2, weight average molecular weight = 7,600, acid value = 48 mgKOH/g) | 12 parts by weight |

-continued

| | |
|---|---|
| Styrene | 80 parts by weight |
| n-butyl acrylate | 20 parts by weight |
| copper phthalocyanine blue | 6 parts by weight |
| 2,2'-azobisisobutyronitrile | 4 parts by weight |

This mixture was added to the solution and mixed well by TK homomixer at 12000 rpm for 10 minutes. Then the temperature of an oil bath was set to 70° C. and polymerization was carried out for 12 hours.

After the dispersion was cooled to a room temperature, the solid/liquid separation and cleaning of the dispersion were repeatedly carried out. As a cleaning solvent, water was employed. When a total of four cleaning cycles were carried out, the slurry was dried to give toner particles having a number average particle diameter (Dn) of 4.36 μm, and the coefficient of variation of number distribution of 34.0%. The particles were classified using a multi-division classifier to give toner particles having a number average particle diameter (Dn) of 4.13 μm, and the coefficient of variation of number distribution of 22.8%.

The toner particles were extracted with methanol for 24 hours, and the ratio of the resin component extracted by methanol was 4.8% by weight of the toner particles.

The acid value and GPC molecular weight distribution of the solvent soluble resin component extracted by methanol were measured in a process analogous to that of Example 1, and the acid value was 42 mgKOH/g, and the weight average molecular weight of the resin component was 5900, and the component having a molecular weight of from 200 to 1000 was in an amount of 3.6% by weight of the toner particles. Regarding the repeating units (I) and (II), see Table 1.

Then silica was externally added in a process analogous to that of Example 1. The physical properties of the obtained toner particles are given in Table 2.

A developing agent was prepared in a process analogous to that of Example 1 and the charge quantity was measured. The result was L/L:−54.6 μC/g, N/N:−37.8 μC/g, and H/H:−28.2 μC/g. The difference in the charge quantity under different environments was very large.

Picture image evaluation under L/L, N/N and H/H environments was carried out in a process analogous to that of Example 1.

The results are given in Table 3. The results were inferior with regard to the reproducibility of halftone, and the fogging.

Comparative Example 4

100 wt parts of styrene-acrylic acid-n-butyl acrylate copolymer (copolymerization composition ratio=50:30:20, Mw=15,400, acid value=149 mgKOH/g) and 6 parts by weight of copper phthalocyanine blue were mixed by Henschel mixer and kneaded by a pressure kneader and pulverized by jet mill to give particles. The obtained particles were dispersed in water and heated at 80° C. for 2 hours, then dried and classified to give toner particles. The number average particle diameter (Dn) was 4.90 μm, and the coefficient of variation of number distribution was 24.0%.

The toner particles were extracted with a methanol solution for 24 hours, and the ratio of the component extracted by methanol was 15.4% by weight of the toner particles.

The acid value and GPC molecular weight distribution of the methanol soluble resin component extracted by methanol were measured in a process analogous to that of Example 1, and the acid value was 145 mgKOH/g, and the weight average molecular weight of the resin component was 14,400, and the component having a molecular weight of from 200 to 1000 was in an amount of 4.1% by weight of the toner particles. Regarding the repeating units (I) and (II), see Table 1.

Then silica was externally added in a process analogous to that of Example 1. The physical properties of the obtained toner particles are given in Table 2.

A developing agent was prepared in a process analogous to that of Example 1 and the charge quantity was measured. The result was L/L:−44.9 μC/g, N/N:−40.2 μC/g, and H/H:−27.7 μC/g. The difference in the charge quantity under different environments was very large.

Picture image evaluation under L/L, N/N and H/H environments was carried out in a process analogous to that of Example 1.

The results are given in Table 3. The results were inferior with regard to the developing of halftone, and the picture image density was low under a low temperature and low humidity environment.

Comparative Example 5

Toner particles were produced in a process analogous to that of Example 1 except that the nitrogen was bubbled at 100 ml/min for 5 minutes. The amount of the dissolved oxygen measured at the start of the polymerization was 3.2 mg/l. The obtained toner particles had a number average particle diameter (Dn) of 2.21 μm, and the coefficient of variation of number distribution of 31.6%.

The toner particles were extracted with a methanol solution for 24 hours, and the ratio of the resin component extracted by methanol was 10.4% by weight of the toner particles.

The acid value and GPC molecular weight distribution of the methanol soluble resin component extracted by methanol were measured in a process analogous to that of Example 1, and the acid value was 306 mgKOH/g, and the weight average molecular weight of the resin component was 43,400, and the component having a molecular weight of from 200 to 1000 was in an amount of 3.2% by weight of the toner particles. Regarding the repeating units (I) and (II), see Table 1.

Then silica was externally added in a process analogous to that of Example 1. The physical properties of the obtained toner particles are given in Table 2.

A developing agent was prepared in a process analogous to that of Example 1 and the charge quantity was measured. The result was L/L:−52.8 μC/g, N/N:−49.5 μC/g, and H/H:−47.6 μC/g.

Picture image evaluation under L/L, N/N and H/H environments was carried out in a process analogous to that of Example 1.

The results are given in Table 3. The results showed that the reproducibility of the halftone was inferior.

Comparative Example 6

A mixture was formed of:

| | |
|---|---|
| Methanol | 290 parts by weight |
| Water | 10 parts by weight |

-continued

| | |
|---|---|
| Vinyl phenol-n-butyl acrylate copolymer (weight average molecular weight = 45,000, acid value = 3 mgKOH/g) | 20 parts by weight |
| Styrene | 80 parts by weight |
| n-butyl acrylate | 20 parts by weight |
| carbon black | 6.0 parts by weight |
| di-t-butyl salicylic acid metal compound | 0.5 parts by weight |
| 2,2'-azobisisobutyronitrile | 4.2 parts by weight |

This mixture was added to a reaction vessel and mixed well for 30 minutes while nitrogen was bubbled in at 400 ml/min. The amount of the dissolved oxygen measured at the start of the polymerization was 0.3 mg/l. Then particles were obtained in a process analogous to that of Example 6. The obtained slurry was dried to give toner particles having a number average particle diameter (Dn) of 4.47 μm, and the coefficient of variation of number distribution of 16.9%.

The toner particles were extracted with a methanol solution for 24 hours, and the ratio of the resin component extracted by methanol was 3.8% by weight of the toner particles.

The acid value and GPC molecular weight distribution of the resin component extracted by methanol were measured in a process analogous to that of Example 1, and the acid value was 2 mgKOH/g, and the weight average molecular weight of the resin component was 47,300, and the component having a molecular weight of from 200 to 1000 was in an amount of 0.5% by weight of the toner particles. Regarding the repeating units (I) and (II), see Table 1.

Then silica was externally added in a process analogous to that of Example 1. The physical properties of the obtained toner particles are given in Table 2.

A developing agent was prepared from the obtained toner in a process analogous to that of Example 1 and the charge quantity was measured. The result was L/L:−56.1 μC/g, N/N:−38.3 μC/g, and H/H:−36.4 μC/g. The difference in the charge quantity under different environments was very large.

Picture image evaluation under L/L, N/N and H/H environments was carried out in a process analogous to that of Example 1.

The results are given in Table 3. The results showed that the development of halftone was inferior.

Comparative Example 7

A mixture was formed of:

| | |
|---|---|
| Methanol | 270 parts by weight |
| Polyvinyl ethyl ether (weight average molecular weight = 47,600, acid value = 0 mgKOH/g) | 20 parts by weight |
| Styrene | 40 parts by weight |
| n-butyl acrylate | 20 parts by weight |
| monomethyl maleate | 40 parts by weight |
| copper phthalocyanine blue | 6 parts by weight |
| 2,2'-azobisisobutyronitrile | 4 parts by weight |

2,2'-azobisisobutyronitrile 4 parts by weight

This mixture was added to a reaction vessel and mixed well for 30 minutes while nitrogen was bubbled in at 400 ml/min. The amount of the dissolved oxygen measured at the start of the polymerization was 0.3 mg/l. Then particles were obtained in a process analogous to that of Example 1. The obtained slurry was dried to give toner particles having a number average particle diameter (Dn) of 2.86 μm, and the coefficient of variation of number distribution of 19.7%.

The toner particles were extracted with methanol for 24 hours, and the ratio of the resin component extracted by methanol was 17.3% by weight of the toner particles.

The acid value and GPC molecular weight distribution of the methanol soluble resin component extracted by methanol were measured in a process analogous to that of Example 1, and the acid value was 308 mgKOH/g, and the weight average molecular weight of the resin component was 36,800, and the component having a molecular weight of from 200 to 1000 was in an amount of 0.7% by weight of the toner particles. Regarding the repeating units (I) and (II), see Table 1.

Then silica was externally added in a process analogous to that of Example 7. The physical properties of the obtained toner particles are given in Table 2.

A developing agent was prepared in a process analogous to that of Example 1 and the charge quantity was measured. The result was L/L:−49.2 μC/g, N/N:−44.7 μC/g, and H/H:−21.5 μC/g.

Picture image evaluation under L/L, N/N and H/H environments was carried out in a process analogous to that of Example 1.

The results are given in Table 3. The results showed that the development of halftone and the fogging under a high humidity condition were inferior.

TABLE 1

| | | | Methanol-soluble resin component extracted by methanol | | | | | | |
|---|---|---|---|---|---|---|---|---|---|
| | Number average particle diameter (μm) | Coefficient of variation (%) | Content (wt %) | Acid value (mgKOH/g) | Weight average molecular weight | Content of resin component having molecular weight of. 200–1000 (wt %) | Repeating unit (I) content (%) | Repeating unit (II) content (%) | Ratio of number of repeating units (I) / (I) + (II) |
| Example 1 | 4.60 | 13.4 | 2.1 | 361 | 51200 | 0.5 | 55.7 | 39.4 | 0.59 |
| Example 2 | 4.58 | 15.9 | 2.2 | 317 | 53300 | 0.6 | 47.6 | 48.1 | 0.50 |
| Example 3 | 4.49 | 17.2 | 2.8 | 154 | 35600 | 0.6 | 31.3 | 65.8 | 0.32 |
| Example 4 | 4.62 | 17.1 | 2.2 | 425 | 52900 | 0.5 | 68.2 | 30.5 | 0.69 |
| Example 5 | 5.89 | 15.5 | 2.4 | 340 | 50700 | 0.6 | 54.1 | 41.3 | 0.57 |
| Example 6 | 1.41 | 8.6 | 3.6 | 348 | 50900 | 0.4 | 52.8 | 42.7 | 0.55 |
| Example 7 | 3.34 | 10.8 | 5.1 | 192 | 30100 | 0.3 | 28.9 | 61.0 | 0.32 |
| Example 8 | 3.50 | 15.4 | 4.8 | 123 | 43800 | 0.9 | 19.4 | 40.5 | 0.32 |
| Example 9 | 3.47 | 19.7 | 4.3 | 118 | 43100 | 1.6 | 19.3 | 38.8 | 0.33 |
| Example 10 | 3.47 | 15.6 | 8.7 | 205 | 29000 | 0.8 | 28.5 | 60.4 | 0.32 |
| Example 11 | 4.58 | 14.7 | 0.1 | 347 | 51300 | 0.2 | 55.6 | 39.1 | 0.59 |
| Example 12 | 4.61 | 14.2 | 9.5 | 369 | 51100 | 1.1 | 54.9 | 38.8 | 0.59 |
| Comparative example 1 | 4.63 | 18.3 | 4.7 | 624 | 55800 | 1.5 | 87.7 | 11.4 | 0.89 |
| Comparative example 2 | 4.55 | 19.8 | 2.4 | 39 | 11500 | 8.4 | 8.8 | 0 | 1.00 |
| Comparative example 3 | 4.13 | 22.8 | 4.8 | 42 | 5900 | 3.6 | 11.7 | 53.8 | 0.18 |
| Comparative example 4 | 4.90 | 24.0 | 15.4 | 145 | 14400 | 4.1 | 29.8 | 50.3 | 0.37 |
| Comparative example 5 | 2.21 | 31.6 | 10.4 | 306 | 43400 | 3.2 | 46.4 | 41.2 | 0.53 |
| Comparative example 6 | 4.47 | 16.9 | 3.8 | 2 | 47300 | 0.5 | 0 | 78.3 | 0.00 |
| Comparative example 7 | 2.86 | 19.7 | 17.3 | 308 | 36800 | 0.7 | 46.5 | 27.8 | 0.63 |

TABLE 2

| | | | Methanol-soluble resin component extracted by methanol | | | | | | |
|---|---|---|---|---|---|---|---|---|---|
| | Number average particle diameter (μm) | Coefficient of variation (%) | Content (wt %) | Acid value (mgKOH/g) | Weight average molecular weight | Content of resin component having molecular weight of. 200–1000 (wt %) | Repeating unit (I) content (%) | Repeating unit (II) content (%) | Ratio of number of repeating units (I) / (I) + (II) |
| Example 1 | 4.61 | 13.1 | 2.1 | 358 | 51100 | 0.5 | 55.6 | 39.4 | 0.59 |
| Example 2 | 4.59 | 15.6 | 2.2 | 319 | 53400 | 0.5 | 47.7 | 48.0 | 0.50 |
| Example 3 | 4.52 | 16.9 | 2.8 | 157 | 35500 | 0.6 | 31.5 | 65.7 | 0.32 |
| Example 4 | 4.64 | 16.8 | 2.2 | 421 | 52700 | 0.5 | 68.1 | 30.5 | 0.69 |
| Example 5 | 5.90 | 15.4 | 2.3 | 338 | 50900 | 0.5 | 54.0 | 41.2 | 0.57 |
| Example 6 | 1.43 | 8.6 | 3.5 | 351 | 50800 | 0.4 | 52.9 | 42.8 | 0.55 |
| Example 7 | 3.35 | 10.7 | 5.0 | 190 | 30300 | 0.3 | 28.7 | 60.8 | 0.32 |
| Example 8 | 3.52 | 15.1 | 4.7 | 119 | 43700 | 0.9 | 19.4 | 40.4 | 0.32 |
| Example 9 | 3.50 | 19.3 | 4.3 | 120 | 43200 | 1.5 | 19.4 | 39.0 | 0.33 |
| Example 10 | 3.49 | 15.4 | 8.6 | 206 | 29100 | 0.8 | 28.5 | 60.2 | 0.32 |

TABLE 2-continued

| | Number average particle diameter (μm) | Coefficient of variation (%) | Methanol-soluble resin component extracted by methanol: Content (wt %) | Acid value (mgKOH/g) | Weight average molecular weight | Content of resin component having molecular weight of. 200–1000 (wt %) | Repeating unit (I) content (%) | Repeating unit (II) content (%) | Ratio of number of repeating units (I) / (I) + (II) |
|---|---|---|---|---|---|---|---|---|---|
| Example 11 | 4.59 | 14.5 | 0.1 | 345 | 51400 | 0.2 | 55.8 | 39.3 | 0.59 |
| Example 12 | 4.63 | 14.1 | 9.4 | 372 | 51300 | 1.1 | 54.8 | 38.7 | 0.59 |
| Comparative example 1 | 4.65 | 18.1 | 2.6 | 628 | 55600 | 1.5 | 87.9 | 11.4 | 0.89 |
| Comparative example 2 | 4.58 | 19.6 | 2.4 | 38 | 11300 | 8.2 | 8.7 | 0.0 | 1.00 |
| Comparative example 3 | 4.35 | 22.9 | 4.7 | 42 | 5800 | 3.6 | 11.6 | 53.6 | 0.18 |
| Comparative example 4 | 4.93 | 23.9 | 15.3 | 144 | 14500 | 4.2 | 29.8 | 50.2 | 0.37 |
| Comparative example 5 | 2.25 | 31.2 | 10.3 | 308 | 43600 | 3.1 | 46.5 | 41.1 | 0.53 |
| Comparative example 6 | 4.48 | 16.8 | 3.8 | 2 | 47200 | 0.5 | 0.0 | 99.4 | 0.00 |
| Comparative example 7 | 2.86 | 19.7 | 17.3 | 308 | 36800 | 0.7 | 46.5 | 27.8 | 0.63 |

TABLE 3

| | Charge quantity (μC/g) | | | Image density | | | Halftone | | | Fogging | | |
|---|---|---|---|---|---|---|---|---|---|---|---|---|
| | L/L | N/N | H/H | L/L | N/N | H/H | L/L | N/N | H/H | L/L | N/N | H/H |
| Example 1 | −41.1 | −40.6 | −39.8 | 1.47 | 1.48 | 1.48 | A | A | A | A | A | A |
| Example 2 | −43.2 | −40.8 | −38.5 | 1.44 | 1.47 | 1.48 | A | A | A | A | A | A |
| Example 3 | −44.6 | −40.5 | −37.8 | 1.44 | 1.47 | 1.49 | B | A | A | A | A | B |
| Example 4 | −43.8 | −40.3 | −37.4 | 1.45 | 1.47 | 1.48 | B | B | A | A | A | A |
| Example 5 | −34.1 | −32.4 | −30.6 | 1.50 | 1.52 | 1.54 | B | B | B | A | A | A |
| Example 6 | −48.3 | −45.2 | −39.7 | 1.36 | 1.38 | 1.43 | B | A | A | A | A | C |
| Example 7 | −43.5 | −38.4 | −35.1 | 1.41 | 1.44 | 1.47 | A | A | A | A | A | A |
| Example 8 | −43.2 | −38.1 | −35.3 | 1.42 | 1.46 | 1.47 | B | B | A | A | B | B |
| Example 9 | −44.4 | −38.3 | −34.5 | 1.41 | 1.45 | 1.46 | C | B | A | A | B | B |
| Example 10 | −43.3 | −38.4 | −32.9 | 1.42 | 1.45 | 1.48 | A | A | A | A | A | A |
| Example 11 | −49.5 | −40.3 | −35.8 | 1.37 | 1.47 | 1.49 | C | A | A | A | A | B |
| Example 12 | −43.2 | −39.7 | −31.7 | 1.46 | 1.49 | 1.51 | B | B | B | A | B | C |
| Comparative example 1 | −45.1 | −38.7 | −29.6 | 1.40 | 1.48 | 1.51 | C | B | B | A | B | D |
| Comparative example 2 | −53.2 | −38.1 | −31.3 | 1.36 | 1.46 | 1.50 | D | B | B | B | C | D |
| Comparative example 3 | −54.6 | −37.8 | −28.2 | i.32 | 1.47 | 1.54 | D | B | B | B | C | C |
| Comparative example 4 | −44.9 | −40.2 | −27.7 | 1.43 | 1.46 | 1.51 | C | C | D | B | B | D |
| Comparative example 5 | −52.8 | −49.5 | −47.6 | 1.29 | 1.31 | 1.32 | D | D | C | B | C | C |
| Comparative example 6 | −56.1 | −38.3 | −36.4 | 1.34 | 1.49 | 1.51 | D | B | B | A | B | B |
| Comparative example 7 | −49.2 | −44.7 | −21.5 | 1.33 | 1.36 | 1.47 | C | B | D | B | C | E |

What is claimed is:

1. A toner containing at least a binder resin and a colorant, comprising (i) a number average particle diameter thereof is from 0.5 to 6.0 μm, (ii) the coefficient of variation of number distribution of not more than 20%, and (iii) a methanol-soluble resin component which is extracted by methanol solvent in an amount of 0.01–10% by weight based on the weight of the toner, wherein said methanol-soluble resin component contains a polymer composition having an organic acid group, and an acid value (Av) from 50 to 600 mgKOH/g.

2. The toner according to claim 1, wherein the organic acid group contained in the polymer composition is a carboxyl group.

3. The toner according to claim 1, wherein the polymer composition having the organic acid group is a copolymer containing α-methyl styrene as a structural unit.

4. The toner according to claim 1, wherein the polymer composition containing the organic acid group is a copolymer containing α-methyl styrene and styrene as structural units.

5. The toner according to claim 1, wherein the polymer composition having the organic acid group is a copolymer selected from the group consisting of styrene-α-methyl styrene-acrylic acid-methacrylic acid copolymer, styrene-α-methyl styrene-acrylic acid copolymer, styrene-α-methyl styrene-methacrylic acid copolymer and styrene-α-methyl styrene-acrylic acid-ethyl acrylate copolymer.

6. The toner according to claim 1, wherein the methanol-soluble resin component contains at least one repeating unit (I) and at least one repeating unit (II) represented by the following structural formulae, and the total number of the repeating unit (I) and the repeating unit (II) in the methanol-soluble resin component is not less than 50% of the number of the units comprising the entire methanol-soluble resin component, and the number of the repeating unit (I) is 30–70% of the total number of the repeating unit (I) and unit (II);

(I)

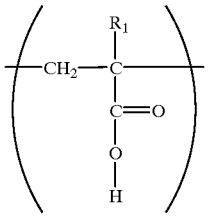

(II)

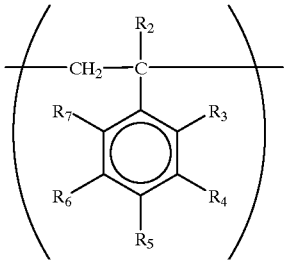

wherein, $R_1$, and $R_2$, represent hydrogen atom, a substituted or unsubstituted alkyl group or a halogen atom, $R_3$–$R_7$ represent hydrogen atom, a substituted or unsubstituted alkyl group, a halogen atom, nitrile group, hydroxyl group, carboxyl group, sulfonic group or amino group.

7. The toner according to claim 1, wherein, in the molecular weight distribution pattern obtained by measurement by gel permeation chromatography (GPC) converted to polystyrene basis, the methanol-soluble resin component has (i) a weight average molecular weight (Mw) from 4,000 to 400,000, and (ii) a component having a molecular weight of 200–1000 in an amount from 0.01 to 3% by weight based on the weight of the toner.

8. The toner according to claim 1, wherein the methanol-soluble resin component is contained in an amount from 0.2 to 8% by weight based on the weight of the toner.

9. The toner according to claim 1, wherein the methanol-soluble resin component is contained in an amount from 0.5 to 7.5% by weight based on the weight of the toner.

10. The toner according to claim 1, wherein the methanol-soluble resin component has an acid value (Av) from 100 to 550 mgKOH/g.

11. The toner according to claim 1, wherein the methanol-soluble resin component has an acid value (Av) from 100 to 500 mgKOH/g.

12. The toner according to claim 1, which has a number average particle diameter from 1.0 to 5.0 μm.

13. The toner according to claim 1, which has the coefficient of variation of number distribution of not more than 18%.

14. A process for producing a toner comprising the steps of:

(a) dissolving (i) a polymerizable monomer which is soluble in a polymerization solvent and which forms a polymer by polymerization which is not soluble in said polymerization solvent and (ii) a polymer composition containing an organic acid group, in said polymerization solvent to prepare a polymerization reaction system;

(b) polymerizing said polymerizable monomer in the presence of a polymerization initiator by controlling the amount of dissolved oxygen in said polymerization reaction system at the start of the polymerization reaction to not more than 2.0 mg/l to form toner particles; and (c) obtaining toner particles from said polymerization reaction system and forming a toner from the toner particles;

wherein the polymer composition containing the organic acid group is soluble in said polymerization solvent and has an acid value from 50 to 600 mgKOH/g, wherein the toner comprising (i) a number average particle diameter from 0.5 to 6.0 μm, (ii) the coefficient of variation of number distribution is not more than 20%, and (iii) a methanol-soluble resin component which is extracted by methanol solvent in an amount of 0.01–10% by weight based on the weight of the toner and wherein said methanol-soluble resin component contains the polymer composition having an organic acid group, and an acid value (Av) of from 50 to 600 mgKOH/g.

15. The process according to claim 14, wherein the amount of dissolved oxygen is controlled to not more than 2.0 mg/l by bubbling an inactive gas into the polymerization reaction system.

16. The process according to claim 14, wherein the amount of dissolved oxygen is controlled to not more than 2.0 mg/l by applying ultrasonic waves to the polymerization reaction system to carry out deoxygenation.

17. The process according to claim 14, wherein the amount of the dissolved oxygen is controlled to not more than 2.0 mg/l by bubbling an inactive gas into the polymerization reaction system and by applying ultrasonic waves to the polymerization reaction system to carry out deoxygenation.

18. The process according to claim 14, which further comprises a step of cleaning toner particles with a cleaning solvent containing a saturated alcohol represented by the following chemical formula 1 in an amount of not less than 30 by weight, based on the weight of the cleaning solvent following the step in which the toner particles are obtained from the polymerization reaction system;

$C_nH_{2n+1}OH(n=1-5)$ chemical formula 1.

19. The process according to claim 17, wherein the cleaning solvent contains water in an amount of from 0.1 to 70% by weight based on the weight of the cleaning solvent.

20. The process according to claim 14, wherein the organic acid group contained in the polymer composition is carboxyl group.

21. The process according to claim 14, wherein the polymer composition containing the organic acid group is a copolymer containing α-methyl styrene as a structural unit.

22. The process according to claim 14, wherein the polymer composition containing the organic acid group is a copolymer containing a-methyl styrene and styrene as structural units.

23. The process according to claim 14, wherein the polymer composition containing the organic acid group is a copolymer selected from the group consisting of styrene-α-methyl styrene-acrylic acid-methacrylic acid copolymer, styrene-α-methyl styrene-acrylic acid copolymer, styrene-α-methyl styrene-methacrylic acid copolymer and styrene-α-amethyl styrene-acrylic acid-ethyl acrylate copolymer.

24. The process according to claim 14, wherein the methanol-soluble resin component contains at least one repeating unit (I) and at least one repeating unit (II) represented by the following structural formulae, and the total number of the repeating unit (I) and the repeating unit (II) in the methanol-soluble resin component is not less than 50% of the number of the units comprising the entire methanol-soluble resin component, and the number of the repeating unit (I) is 30–70% of the total number of the repeating unit (I) and unit (II);

(I)

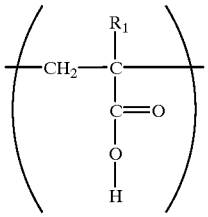

-continued (II)

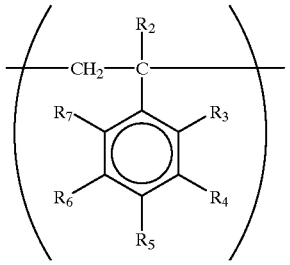

wherein $R_1$ and $R_2$ represent hydrogen atom, a substituted or unsubstituted alkyl group or a halogen atom, $R_3$–$R_7$ represent hydrogen atom, a substituted or unsubstituted alkyl group, a halogen atom, nitrile group, hydroxyl group, carboxyl group, sulfonic group or amino group.

25. The process according to claim 14, wherein, in the molecular weight distribution pattern obtained by measurement by gel permeation chromatography (GPC) converted to polystyrene basis, the methanol-soluble resin component has (i) a weight average molecular weight (Mw) from 4,000 to 400,000, and (ii) a component having a molecular weight of 200–1000 in an amount from 0.01 to 3% by weight based on the weight of the toner.

26. The process according to claim 14, wherein the methanol-soluble resin component is contained in an amount from 0.2 to 8% by weight based on the weight of the toner.

27. The process according to claim 14, wherein the methanol-soluble resin component is contained in an amount from 0.5 to 7.5% by weight based on the weight of the toner.

28. The process according to claim 14, wherein the methanol-soluble resin component has an acid value (Av) from 100 to 550 mgKOH/g.

29. The process according to claim 14, wherein the methanol-soluble resin component has an acid value (Av) from 100 to 500 mgKOH/g.

30. The process according to claim 14, wherein the toner has a number average particle diameter from 1.0 to 5.0 μm.

31. The process according to claim 14, wherein the toner has the coefficient of variation of number distribution of not more than 18%.

* * * * *